US011603666B2

(12) United States Patent
Albracht

(10) Patent No.: US 11,603,666 B2
(45) Date of Patent: Mar. 14, 2023

(54) WALL SHEATHING SYSTEM

(71) Applicant: Gregory P. Albracht, Omaha, NE (US)

(72) Inventor: Gregory P. Albracht, Omaha, NE (US)

( * ) Notice: Subject to any disclaimer, the term of this patent is extended or adjusted under 35 U.S.C. 154(b) by 0 days.

(21) Appl. No.: 17/482,652

(22) Filed: Sep. 23, 2021

(65) Prior Publication Data

US 2022/0098872 A1 Mar. 31, 2022

Related U.S. Application Data

(60) Provisional application No. 63/224,610, filed on Jul. 22, 2021, provisional application No. 63/084,212, filed on Sep. 28, 2020.

(51) Int. Cl.
*E04F 13/08* (2006.01)

(52) U.S. Cl.
CPC ..... *E04F 13/0816* (2013.01); *E04F 13/0864* (2013.01)

(58) Field of Classification Search
CPC . E04F 13/0816; E04F 13/0864; E04F 13/007; E04F 13/12; E04F 13/083; E04F 19/04; E04F 19/0436; E04F 19/022; E04B 2/7453; E04B 2/56
See application file for complete search history.

(56) References Cited

U.S. PATENT DOCUMENTS 2,562,754 A * 7/1951 Van Uum ..... E04F 13/0812 52/712
3,243,930 A * 4/1966 Slowinski ..... E04B 2/789 52/363
6,289,646 B1 * 9/2001 Watanabe ..... E04F 13/083 52/489.1
9,080,331 B2 * 7/2015 Aboukhalil ..... E04F 13/0816
9,834,941 B1 * 12/2017 Bilge ..... E04F 13/12
D809,163 S * 1/2018 Bilge ..... D25/123
9,874,026 B2 * 1/2018 Bilge ..... E04F 13/0891
10,011,997 B1 * 7/2018 Bilge ..... E04F 13/0801
2003/0056457 A1 * 3/2003 Zeeff ..... E04F 13/12 52/522
2013/0291465 A1 * 11/2013 Resso ..... E04F 13/007 52/302.1
2017/0260752 A1 * 9/2017 Bilge ..... E04F 19/0463
(Continued)

*Primary Examiner* — Brian E Glessner
*Assistant Examiner* — Adam G Barlow
(74) *Attorney, Agent, or Firm* — United IP Counselors, LLC; Kenneth M. Fagin

(57) ABSTRACT

A sheathed building uses corrugated hat-channel furring channels to attach metal panels to an underlying wall structure in a semi-floating manner. The corrugated furring channels are attached to backsides of the metal panels using high-bond-strength tape, and the corrugated furring channels are "hooked" onto corrugated flanges of rail brackets that have been attached to the wall structure to secure the metal panels to the building. Using tape instead of conventional fasteners (e.g., screws or nails) reduces penetrations through the panels and reduces moisture behind the panels. The corrugations facilitate drainage of moisture from behind the panels and drying air circulation. In other embodiments such as a clapboard arrangement of metal panels, rail brackets are not used, and the corrugated furring channels are used to mount the panels in overlapping fashion with no fasteners penetrating through the panels.

3 Claims, 36 Drawing Sheets

(56) References Cited

U.S. PATENT DOCUMENTS

| | | | | |
|---|---|---|---|---|
| 2018/0283013 | A1* | 10/2018 | Diercks | E04F 13/0887 |
| 2019/0194954 | A1* | 6/2019 | Baltz, Jr. | E04B 1/7076 |
| 2020/0063432 | A1* | 2/2020 | Baltz, Jr. | E04B 1/7076 |
| 2020/0157798 | A1* | 5/2020 | Baltz, Jr. | E04F 19/02 |

* cited by examiner

WALL SHEATHING SYSTEM

CROSS-REFERENCE TO RELATED APPLICATIONS

This application claims the priority benefit of U.S. provisional application 63/084,212 filed Sep. 28, 2020, and U.S. provisional application 63/224,610 filed Jul. 22, 2021, the contents of both of which are incorporated herein by reference

BACKGROUND AND FIELD OF THE INVENTION

Concepts disclosed herein pertain to wall construction, particularly including systems for mounting cladding or siding to an underlying wall structure.

In a rainscreen system, cladding or siding panels (referred to herein simply as panels), which form the outer "skin" or surface of a building, are spaced from the underlying structural walls of the building by a gap on the order of one-half inch or so. The gap allows air to circulate over the surface of a moisture barrier that has been secured to the wall beforehand, while permitting rain, condensation, or other moisture to drain from between the panels and the wall, thereby preventing rot, mold, and other degradation of the wall.

Typically, the gap is formed by attaching furring strips to the wall using screws, e.g., secured into underlying studs, with an air/water-resistant membrane secured between the furring strips and the wall before the furring strips are attached. The panels are then secured to the furring strips, also using screws, nails, staples, etc.

This conventional method for installing furring strips and the panels has certain drawbacks, however. First, for horizontally applied furring strips, the furring strips are typically spaced on the order of 16 to 24 inches apart, and there must be intermittent spaces or "breaks" in the furring strips to allow moisture to drain from behind the panels. Typically, a furring arrangement referred to as "double-strapping" is used, with one layer of furring installed vertically and the other layer—provided for attaching siding or cladding—is then screwed over the vertical furring every 8 to 16 inches. As a result, the number of individual segments of furring strips that must be cut and individually attached to the wall can be high, thus making the overall process for cladding a building rather time-consuming.

Additionally, because the panels are typically "hard-fastened" to the furring strips using screws, nails, etc., the panels can warp, twist, buckle, or tear slightly (where the fasteners pass through the panels) as the building settles and/or as the panels expand and contract with weather-related heating and cooling. Furthermore, because the fasteners pass through the panels, they create numerous points of entry where moisture can seep into the gap, even if gasketed fasteners are used to attach the panels to the furring.

SUMMARY OF THE CLAIMED INVENTION

A sheathed building uses corrugated furring channels (e.g., formed as hat channels with corrugated flanges) to attach metal panels to an underlying wall structure in a semi-floating manner. The corrugated furring channels are attached to backsides of the metal panels using high-bond-strength tape, and the corrugated furring channels are "hooked" onto corrugated flanges of rail brackets that have been attached to the wall structure to secure the metal panels to the building. Using tape instead of conventional fasteners (e.g., screws or nails) reduces penetrations through the panels and reduces moisture behind the panels. The corrugations facilitate drainage of moisture from behind the panels and drying air circulation. In other embodiments such as a clapboard arrangement of metal panels, rail brackets are not used, and the corrugated furring channels are used to mount the panels in overlapping fashion with no fasteners penetrating through the panels.

Thus, in one aspect, the claimed invention provides a structural assembly such as a building that includes a vertical wall structure. At least one rail bracket is attached to the vertical wall structure and extends in a horizontal direction, with an upwardly extending, corrugated, rail-bracket free flange. A panel to be attached to the vertical wall structure has at least one horizontally extending furring channel attached to a back surface thereof. The furring channel has a central base portion by means of which the furring channel is attached to the back surface of the panel and a first corrugated furring-channel flange that extends in a downward direction. The panel is mounted to the wall structure, with at least some freedom to move relative to the wall structure, by means of the first corrugated furring-channel flange hooking onto the corrugated rail-bracket free flange, and the corrugated nature of the rail-bracket free flange and the first furring-channel flange provides spaces through which moisture drains from between the panel and the wall structure and through which air circulates.

In embodiments, the furring channel may be attached to the back surface of the panel by a foam-core, double-sided tape disposed between the central base portion of the furring channel and the back surface of the panel. The furring channel may have a hat-shaped cross-sectional profile, with a second corrugated furring-channel flange that extends in an upward direction.

In another aspect, the claimed invention provides a clapboard structural assembly such as a building with a vertical wall structure. A first horizontally extending panel is mounted to the wall structure and has an upper edge that is spaced from the wall structure by a first distance and a lower edge that is spaced from the wall structure by a second distance that is greater than the first distance. The first horizontally extending panel has a first corrugated furring channel attached to a back surface thereof that extends along the first horizontally extending panel near the upper edge thereof. A second horizontally extending panel is mounted to the wall structure above the first horizontally extending panel, with a lower edge that overlaps the upper edge of the first horizontally extending panel and a second corrugated furring channel attached to and extending along a back surface thereof near an upper edge thereof. The second corrugated furring channel is attached to the wall structure so as to secure the upper edge of the second horizontally extending panel to the wall structure at a distance therefrom that is the same as the first distance.

In yet another aspect, the claimed invention provides a clapboard structural assembly such as a building with a vertical wall structure. A plurality of plank-shaped metal panels are attached to and extend horizontally along a surface of the vertical wall structure. Each of the metal panels has a furring channel with a corrugated flange attached to a rear surface of the metal panel via foam-core, double-sided tape near an upper edge of the metal panel, with the corrugated furring channel extending horizontally along the rear surface of the metal panel and with the metal panel secured to the wall structure by fasteners passing through the corrugated flange of the furring channel. A lower edge portion of each metal panel overlaps the upper edge and the attached corrugated furring channel of a metal panel immediately below it.

BRIEF DESCRIPTION OF THE DRAWINGS

These and other features and benefits of the claimed invention will be more fully understood in view of the detailed description below and the figures, in which:

DESCRIPTION OF EMBODIMENTS

Figure 1:
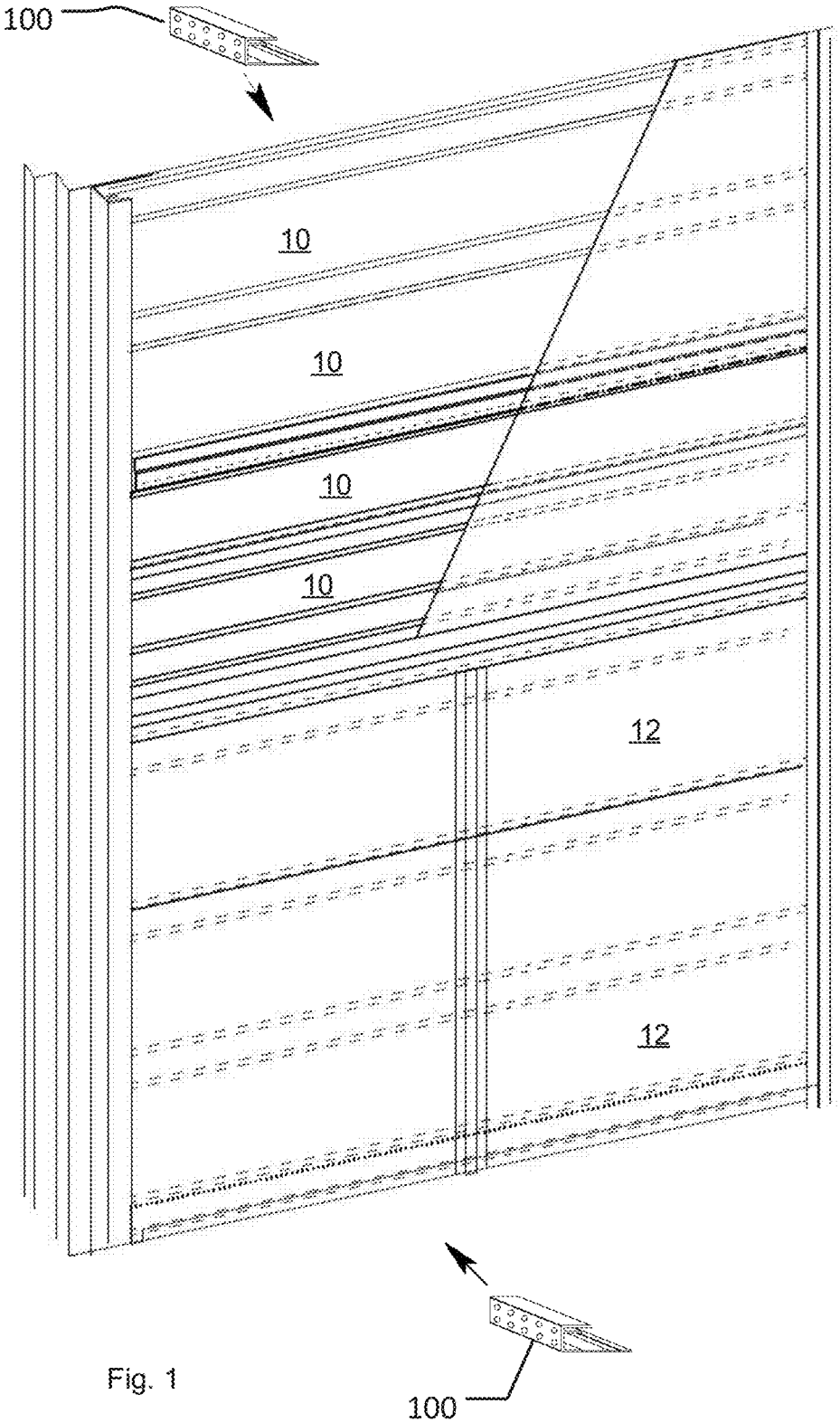
FIG. 1 is a schematic perspective view illustrating wall sheathing system in accordance with the claimed invention.

A wall cladding or sheathing system embodying inventive concepts used in a first embodiment is illustrated in FIGS. 1-5 and 6A-6F, which illustrate several components that are used with the system to clad or sheathe the underlying wall structure 10 of a building. In general, the components include metal panels 12; corrugated steel furring channels 14; thick, high-bond-strength tape 16; and corrugated steel rail brackets 18. Additionally, the system includes a variety of extruded metal channels or trim strips as illustrated in FIGS. 6A-6H, which may be used to "finish" an installation.

As illustrated in greater detail in FIGS. 2-5, a central concept in a first embodiment of this system pertains to how the panels 12 are attached to the wall structure 10 of the building. In general according to this first-embodiment concept, the rail brackets 18 are secured to and extend horizontally along the wall structure 10 of the building, and the metal panels 12 are "hung" on the rail brackets 18 by means of the furring channels 14, which are securely attached to the backsides of the metal panels 12 via the tape 16. The rail brackets 18 (and, accordingly, the furring channels 14) may be vertically spaced apart by on the order of 8 to 24 inches, as per local building codes, with there generally being at least two furring channels 14 attached to each of the metal panels 12.

The furring channels 14 are suitably formed as hat channels, which may be made by extrusion or roll-forming elongated strips of flat sheet steel on the order of 0.030-0.080 inch thick to yield the final cross-sectional hat profile having a central base portion 20, wall portions 22 extending from the central base portion 20, and corrugated flanges 24 extending from the ends of the wall portions 22. The wall portions 22 may extend at a slightly inclined angle relative to the central base portion 20, as illustrated, or they may extend more nearly perpendicularly relative to the central base portion 20, as desired. The flanges 24, on the other hand, preferably are essentially parallel to the central base portion 20 (i.e., within plus or minus 2 degrees), as illustrated.

Furthermore, it is desirable for the corrugated flanges 24 to have bumps 28 (FIG. 3B) formed on the sides of the flanges 24 that face away from the central base portion 20 of the furring channels 14, with the bumps 28 extending farther in that direction than the crests of the corrugations 26 extend. Preferably, these bumps 28 are formed on each corrugation crest, although they may be longitudinally spaced, in the direction in which the furring channel 14 extends, by a multiple of the crest-to-crest spacing of the corrugations 26. The bumps 28 may be formed as the furring channels 14 are roll-formed, or they may be formed separately in a subsequent roll-forming step as desired.

Figure 3A:
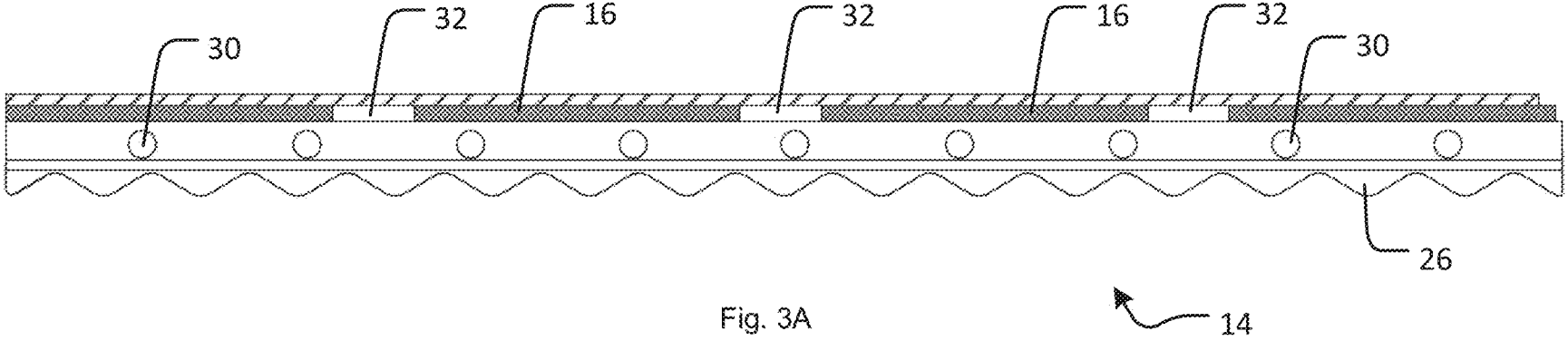
FIGS. 3A and 3B are a schematic plan view and a schematic end view, respectively, illustrating a furring channel used with the wall sheathing system shown in FIGS. 1 and 2.

Further still, the wall portions 22 of the furring channels may have holes or slots 30 formed along the length of the furring channels, as illustrated in FIG. 3A. The holes or slots 30 could be round, oval, rectangular, or any other shape as may be desired, and they can be formed by a punching formation on the rollers used to roll-form the furring channels 14. Alternatively, the holes or slots 30 could be punched or otherwise formed (e.g., by drilling) in a subsequent process. The holes may be longitudinally spaced by the same distance as the bumps 28 are spaced, or they could be spaced apart to a greater or lesser extent.

As will be understood from the further description below of the wall construction system, the bumps 28 help space the furring channels 14 away from the wall structure 10, thereby facilitating drainage of moisture along the surface of the wall structure 10, as indicated by the exaggerated water droplets 31 in FIG. 5, as well as drying air circulation. The holes or slots 30 in the wall portions 22 of the furring channels 14 also facilitate drainage of moisture and circulation of air between the wall structure 10 and the metal panels 12. However, even if bumps 28 and/or slots/holes 30 are not provided, the corrugated nature of the flanges 24 will still facilitate drainage and circulation.

Figure 2:
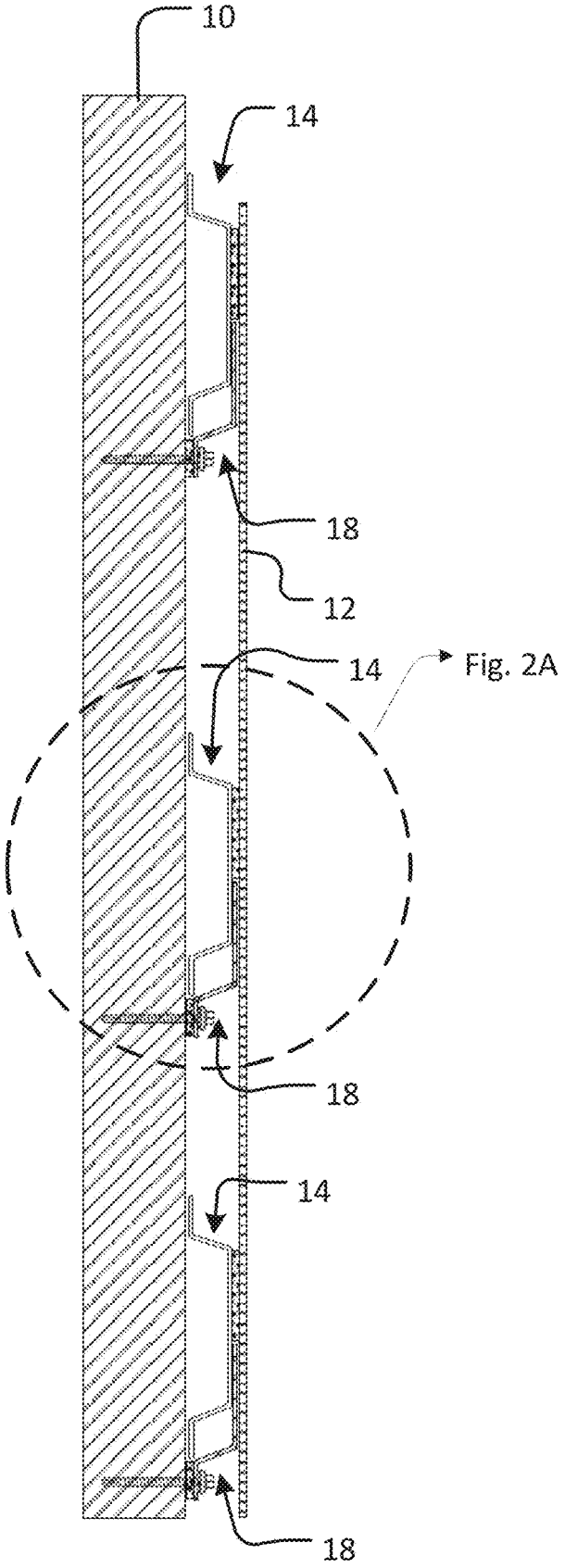
FIG. 2 is a schematic side view, in section, illustrating the attachment of components in the wall sheathing system shown in FIG. 1, with FIG. 2A being an enlarged view of the circled portion in FIG. 2.
Figure 2A:
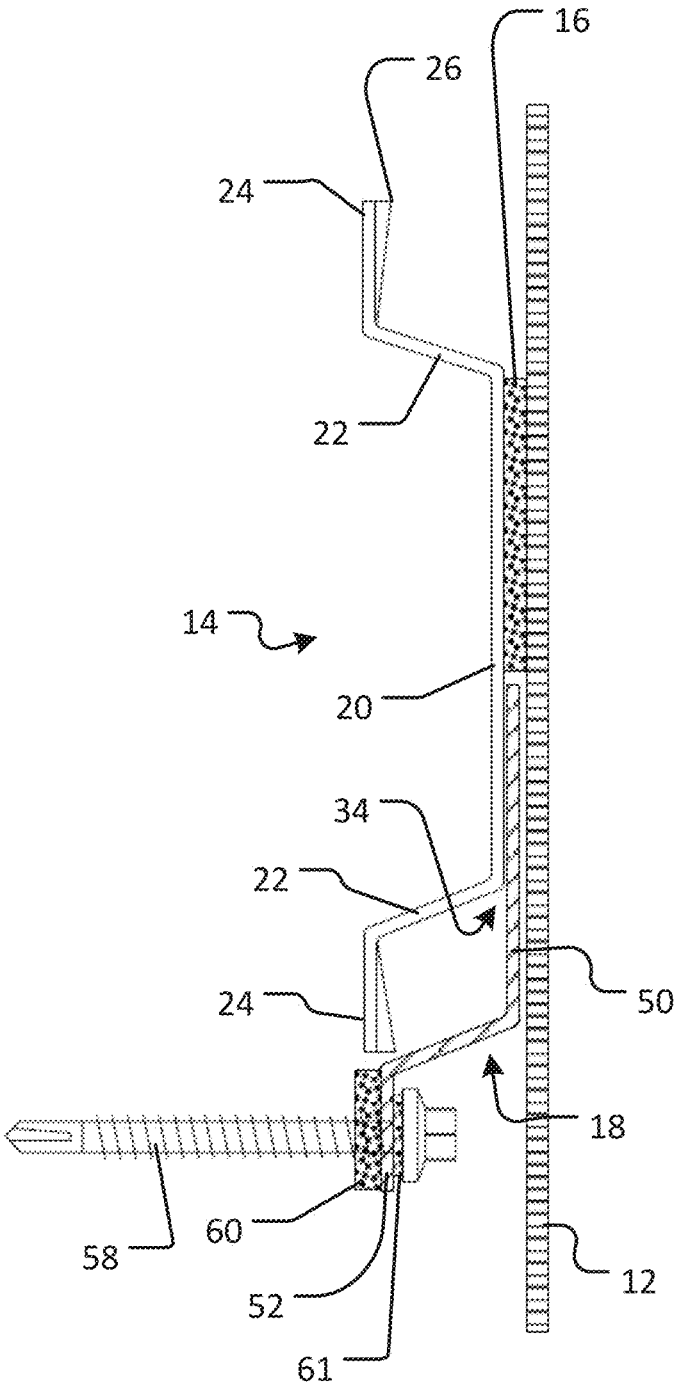

As further illustrated in FIGS. 2-5, the furring channels 14 are secured to the backsides of the metal panels 12 by the thick, high-bond-strength tape 16, with the central base portions 20 of the furring channels 14 positioned closer to the metal panels 12 and the furring channel flanges 24 positioned farther away from the metal panels 12, as most clearly illustrated in FIG. 2A. The tape 16 may be divided into segments, which are longitudinally spaced apart as illustrated in FIG. 3A to form gaps 32 that further facilitate drainage of moisture and air circulation between the wall structure 10 and the metal panels 12. Because the high-bond-strength tape 16 secures the furring channels 14 to the backsides of the metal panels 12, and the furring channels 14 are used to mount the metal panels 12 to the rail brackets 18 and hence to the wall structure 10 as addressed more fully below, the spacing between segments of the tape 16 should be relatively low, e.g., on the order of 3/16 (0.1875) inch, to maintain a net or overall bond strength between the furring channels 14 and the backsides of the metal panels 12 that is as high as possible.

Notably, the tape 16 is thick enough to space the central base portion 20 of the furring channels 14 slightly away from the surface of the metal panels 12, and the tape 16 is applied only along the upper half or so (as oriented in FIG. 2A) of the central base portion 20 of the furring channels 14, thereby forming a gap or pocket 34 between the central base portion 20 and the backside surfaces of the metal panels 12. The width of the gap or pocket 34 should be just about equal to the thickness of the material used to form the rail brackets 18, so that the free flange 50 of the rail brackets 18 can fit closely within the gap or pocket 34 as shown in FIG. 2A and as addressed more fully below. For this purpose, and depending on the specific point of application, I have found that 3M B90F or 3M B16F products, which are double-sided, ¾-inch wide, foam core, high-bond-strength tape products available under the 3M™ VHB™ line of tape products, work well. The B90F product is nominally 0.090 inch thick, and the B16F product is nominally 0.062 inch thick, and each has exceptional bond strength in both shear and tension. Thus, the tape 16 creates the requisite width of the gap or pocket 34 and establishes an essentially permanent bond between the furring channels 14 and the metal panels 12.

If the gap or pocket 34 is slightly wider than the thickness of the free flange 50, it will be fairly easy to mount the metal panels 12 to the rail brackets 18, and there will be "play" that lets the entire expanse of metal panels 12 that have been mounted to the wall structure 10 "float" relative to the wall structure 10, thereby avoiding the warping, twisting, buckling, or tearing alluded to above in the background section. On the other hand, if the gap or pocket 34 is slightly narrower than the thickness of the free flange 50, then there will be an interference fit between the free flange 50 of the rail brackets 18, the surface of the backsides of the metal panels 12, and the outer surfaces of the central base portions 20 of the furring channels 14. (Resilience of the foam core of the tape 16 and inherent flexibility of the free flange 50 of the rail brackets 18 facilitate using such an interference fit.) In this case, the system of panels will be secured more firmly to the wall structure 10, which might be desirable, for example, in regions that are subjected to high winds such as those encountered with hurricanes or tornadoes, while the floating nature of the panel mounting system still helps avoid warping, twisting, buckling, or tearing of the metal panels 12.

Figure 4:
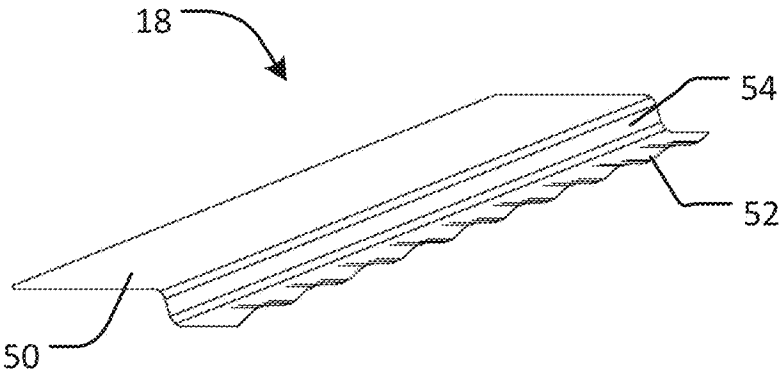
FIG. 4 is a schematic perspective view illustrating a rail bracket used with the wall sheathing system shown in FIGS. 1 and 2.
Figure 3B:
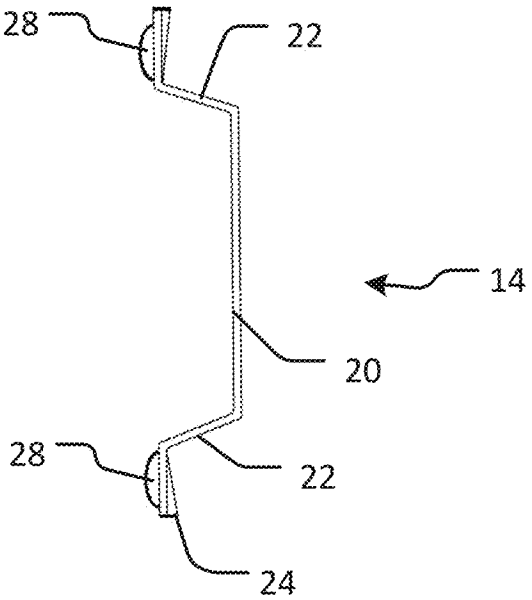

As illustrated in FIGS. 2A and 4 in particular, the rail brackets 18 generally have a Z-shaped or "lazy" Z-shaped profile. As is the case for the furring channels 14, the profile of the rail brackets 18 may be made by roll-forming elongated strips of flat sheet steel on the order of 0.030 to 0.080 inch thick to yield the final cross-sectional Z profile, with a corrugated base portion 52, a wall portion 54 extending from the corrugated base portion 52, and the above-referenced free flange 50 extending from the end of the wall portions 54. The wall portion 54 may extend at a slightly inclined angle relative to the corrugated base portion 52, as illustrated, or it may extend more nearly perpendicularly relative to the corrugated base portion 52, as desired. The free flange 50, on the other hand, should be essentially parallel to the corrugated base portion 52 (i.e., within plus or minus 2 degrees, as illustrated). Generally, the perpendicular distance between the corrugated base portion 52 (as measured from, say, the longitudinal centerline of the corrugations) and the free flange 50 (i.e., distance taken perpendicular to the planes in which each is located) should be slightly more than the perpendicular distance between the furring channel flanges 24 and the central base portion 20 of the furring channels 14, so that the height of the rail brackets 18 is essentially the same as the combined height of the furring channels 14 and the tape 16 that is attached to the furring channels 14.

Furthermore, as is the case for the furring channels 14, it is desirable for the corrugated base portions 52 of the rail brackets 18 to have bumps (not shown) formed on the sides that face away from the free flanges 50, with the bumps extending farther in that direction than the crests of the corrugations extend. Preferably, these bumps are formed on every corrugation crest, although they may be longitudinally spaced, in the direction in which the rail bracket extends, by a multiple of the crest-to-crest spacing of the corrugations on the base portions 52 of the rail brackets 18. As is the case for the furring channels 14, the bumps on the rail brackets 18 may be formed as the rail brackets 18 are roll-formed, or they may be formed separately in a subsequent roll-forming step as desired. It will be recognized that the bumps on the corrugated base portions 52 of the rail brackets 18 help space the rail brackets 18 away from the wall structure 10, thereby enhancing drainage of moisture along the surface of the wall structure 10 as well as drying air circulation. But even if the base portions 52 do not include such bumps, the corrugated nature of the base portions 52 will still facilitate drainage and air circulation to some extent.

Further still, as is the case for the furring channels 14, the wall portions 54 of the rail brackets 18 may also have holes or slots (not illustrated) formed along the length of the rail brackets 18 to facilitate drainage. These holes or slots could be round, oval, rectangular, or any other shape as may be desired, and they can be formed by a punching formation on the rollers used to roll-form the rail brackets 18. Alternatively, the holes or slots could be punched or otherwise formed (e.g., by drilling) in a subsequent process. The holes may be longitudinally spaced by the same distance as bumps (if present) are spaced, or they could be spaced apart to a greater or lesser extent.

Figure 5:
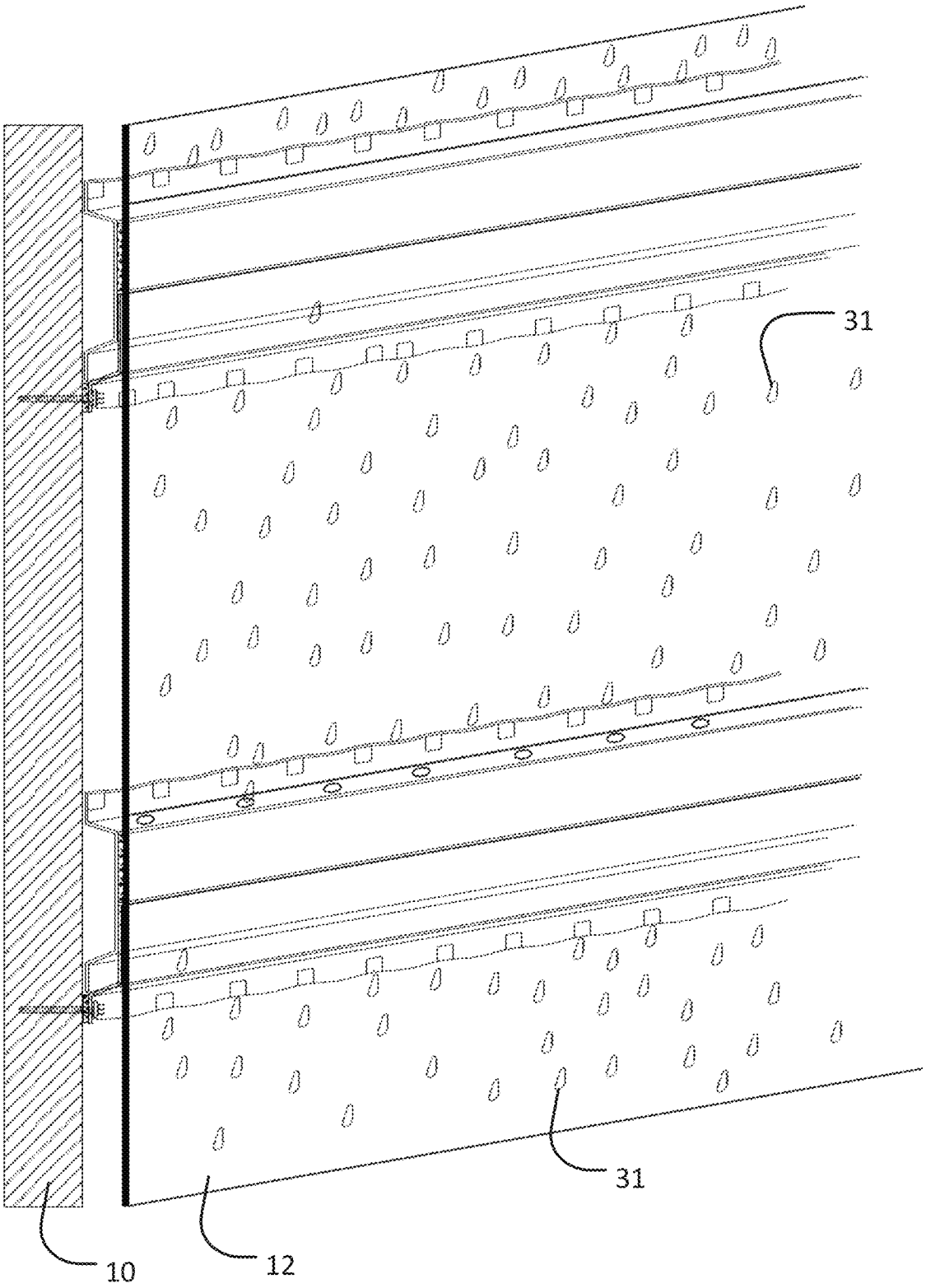
FIG. 5 is a schematic perspective view illustrating moisture-draining and circulation-facilitating benefits of the wall sheathing system illustrated in FIG. 1.

As further illustrated in FIGS. 2, 2A, and 5, the rail brackets 18 preferably are attached to the wall structure 10 by means of screw-type fasteners, e.g., gasketed, self-tapping screws 58, which pass through the corrugated base portions 52 of the rail brackets 18. To facilitate installation, the corrugated base portions 52 may be pre-drilled with holes at longitudinal spacing corresponding to typical building code requirements for the spacing between studs, or the corrugated base portions 52 may be formed without pre-drilled holes, in which case the self-tapping nature of the screws 58 is relied upon to bore out the hole through which the fastener will pass.

Furthermore, a strip of tape 60, which may be of the same type as the tape 16, may be provided on the back surface of the corrugated base portions 52, with a release liner on the exposed surface of the tape 60. (The release liner is removed right before the rail bracket 18 is installed.) This strip of tape 60 forms an additional seal around the shank of the screw 58 to help prevent moisture from seeping into the wall structure 10 (additional to the gasket 61 on the underside of the head of the screw 58, which gets sandwiched between the corrugated base portion 52 of the rail bracket 18 and the head of the screw 58). Additionally, the strip of tape 60 helps adhere the rail brackets 18 to the wall structure 10, with a point of bonding contact at each crest of the corrugations along the base portion 52.

From the figures and the foregoing description, the way a building is clad with panels according to this system should be apparent. After the release liner on the strip of tape 60 is removed (if such a strip of tape 60 is present), a rail bracket 18 is placed against the wall structure 10, with the rail bracket 18 oriented horizontally and the corrugated base portion 52 held against the surface of the wall structure 10. Screws 58 are then driven through the base portion 52, into underlying support structure such as studs behind the wall structure 10, thus securing the rail bracket 18 to the wall structure 10 with the free flange 50 spaced away from the surface of the wall structure 10. Multiple support rails 18 are attached to the wall structure 10 in this manner, with the support rails spaced apart vertically by a distance corresponding to the distance between furring channels 14 on the backsides of the metal panels 12.

A metal panel 12, with furring channels 14 already attached to the backside thereof, will then be placed in position against the wall structure 10, with the furring channels 14 positioned slightly above the rail brackets 18 and the corrugated flanges 24 (particularly the bumps 28, if present) bearing against the wall structure 10. The metal panel 12 is then slid downwardly, thereby causing the free flange 50 on each of the rail brackets 18 to enter the corresponding gap or pocket 34 formed between the central base portion 20 of the furring channel 14 and the backside of the metal panel 12. This results in a very secure attachment of the metal panels 12 to the wall structure 10, while allowing the panels 12 to "float" relative to the wall structure 10 in that the furring channels 14 can shift horizontally and/or vertically relative to the rail brackets 18 as the panel assemblies (panel and attached furring channels 14) expand and contract with heating and cooling. As noted above, this floating arrangement helps prevent warping, buckling, twisting, etc., as the panels 12 expand and contract. Additionally, because the panels 12 are not anchored to the wall structure 10 by fasteners that pass through the panels 12, the panels 12 will not tear (due to pulling against such penetrating fasteners), and incursion of moisture into the space between the panels 12 and the wall structure is minimized.

Further still, a cladding system as disclosed herein has exceptional capacity for moisture and condensation to drain from between the panels 12 and the building structure 10 and for drying air to circulate in that space. This is attributable to the corrugated nature of the furring channel flanges 24 and the rail bracket base portions 52; the bumps on the furring channel flanges 24 and/or the rail bracket base portions 52 (if present); the holes or slots 32 in the furring channel wall portions 22 and/or in the rail bracket wall portions 54 (if present); and the gaps 32 between segments of the tape 16 used to bond the furring channels 14 to the backsides of the metal panels 12. Moreover, a wall system constructed in accordance with the principles disclosed herein has been fire-tested and received a Class A fire rating, with zero flame spread.

As noted above, the wall sheathing system further includes a variety of extruded metal channels or trim strips, which are shown in FIG. 1 (at the edges of the panels 12) and illustrated in greater detail in FIGS. 6A-6H. These channels are used to cover or "hide" edges of the panels 12, generally "close off" the cladding system while still permitting drainage and circulation of drying air between the cladding and the wall structure 10, etc., and they include bottom strips, top strips, panel-to-panel joinder strips, and inside and outside corner strips.

Figure 6A:
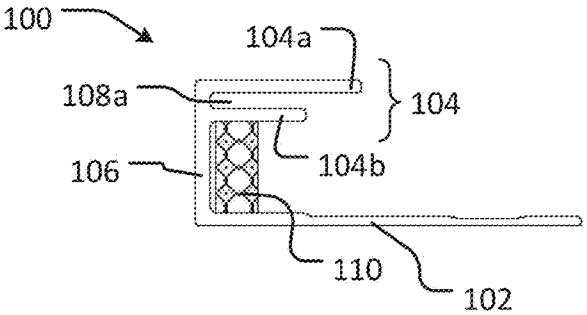
FIGS. 6A-6H are schematic cross-sectional profiles of various channels and trim strips that can be used when installing a wall sheathing system as illustrated in FIG. 1.
Figure 6B:
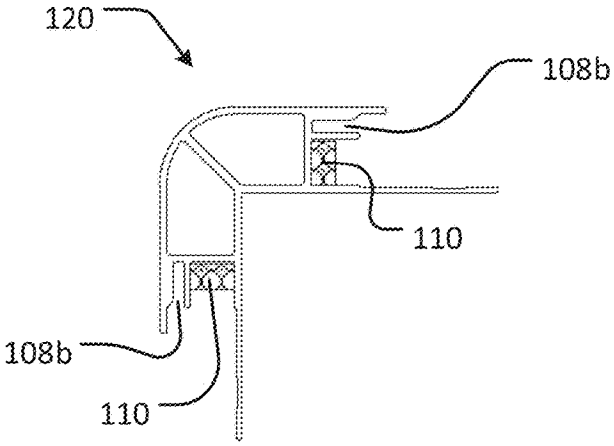
Figure 6C:
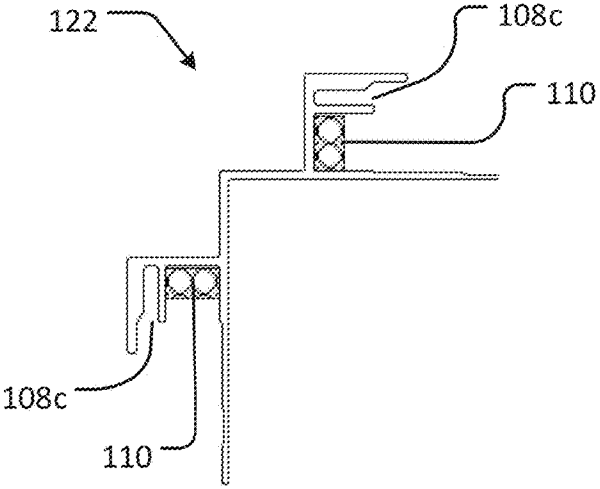
Figure 6D:
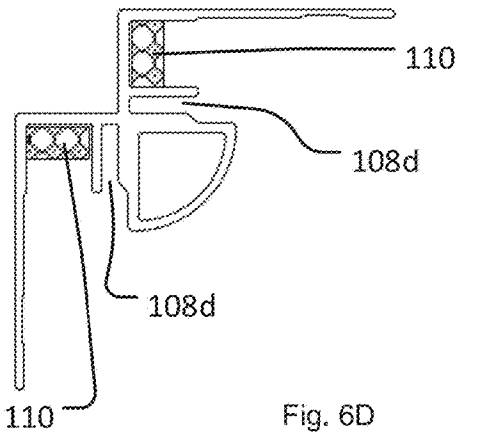
Figure 6G:
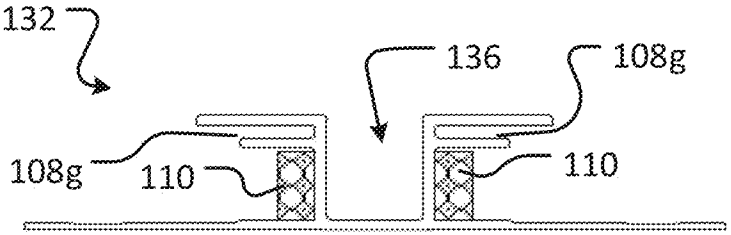
Figure 6H:
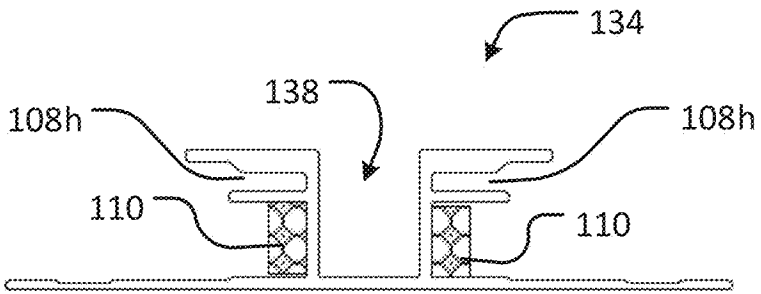
Figure 6E:
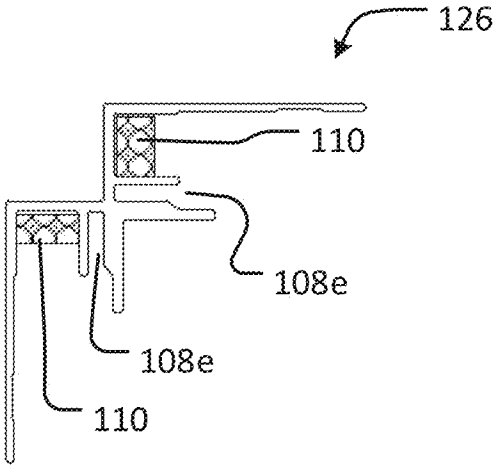
Figure 6F:
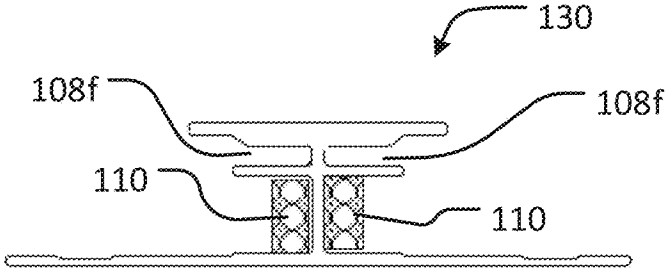

As shown in FIGS. 1 and 6A-6H, top and bottom horizontal starter strips 100 may be formed as J-channels, with long and short leg sections 102, 104 that are connected by a perforated bridge segment 106. The short leg section 104 has a double-wall construction, with an outer wall 104*a* and an inner wall 104*b* that is slightly shorter than the outer wall 104*a*. The inner wall 104*b* is spaced apart from the outer wall 104*a* by a distance that is approximately equal to the thickness of the metal panels 12—preferably slightly less than the thickness of the metal panels 12—to form a slot 108*a*. Additionally, for applications other than use as horizontal starter strips (where drainage is required), the J-channels may include a closed-cell foam insert 110 in the bottom of the J, as illustrated in FIG. 6A, to seal against moisture and air entering behind the panel (beyond that needed for drying circulation behind the panels 12).

These horizontal starter strips 100 may be installed on an upper or lower edge of a panel 12 by inserting the edge of the panel 12 into the slot 108*a*, with the outer wall 104*a* of the short leg section 104 adjacent to the outer-facing surface of the panel 12 and the inner wall 104*b* of the short leg section 104 adjacent to the backside surface of the panel 12. By making the distance between the outer and inner walls 104*a*, 104*b* slightly less than the thickness of the wall panel 12, e.g., on the order of 0.01 or 0.02 inch shorter, the starter strips 100 will be relatively securely attached to the edges of the panels 12 by an interference fit. The panels 12 are then mounted to the wall structure 10 in the manner described above, i.e., with furring channels 14 on the backsides of the panels 12 engaging with rail brackets 18 that have been installed on the wall structure 10, and the long leg section 102 will abut the surface of the wall structure 10 to hold the panel 12 at an appropriate distance from the wall structure 10. The perforations in the bridge segment 106 will allow moisture to drain from behind the panels 12.

If desired, in a configuration that is not illustrated, a length of tape such as the high-bond-strength tape 16 could be applied to the back surface of the long leg section 102, i.e., the surface that bears against the wall structure 10, with a release liner that is removed just prior to installation of the panel 12. This tape would serve to hold the starter strip extremely securely against the wall structure 10 and might be useful in locations where strong winds are more likely to be encountered.

Additional trim-strip profiles that each have an edge-receiving slot (108*b*, 108*c*, 108*d*, 108*e*, 108*f*, 108*g*, or 108*h*), which can be used to "cap off" either horizontally or vertically oriented edges of the panels, are illustrated in FIGS. 6B-6H. These profiles include outside corner profiles 120 and 122; inside corner profiles 124 and 126; single-reveal profiles 130 used to bring panels together in edge-to-edge fashion; and double-reveal profiles 132, 134 used to bring panels together with a gap 136, 138 in between them. Where the trim strips are used horizontally, it may be preferable for the respective bridge segments (i.e., the portions such as bridge segment 106 illustrated in FIG. 6A) to be perforated, to facilitate drainage and, especially in the case of the double-reveal profiles 132 and 134, drying circulation of air behind the panels.

On the other hand, it should be recognized that where these trim strips are used vertically, furring channels 14 on the backs of the panels 12 (which furring channels 14 are oriented horizontally) will meet the trim strips perpendicularly. Because the furring channels 14 are slightly spaced from the back surfaces of the panels 12 by the tape 16, the edges of the panels 12 will be able to fit into the slots 108*a*-108*g* in the trim strips formed between the outer and inner walls of the exterior "leg" (e.g., outer and inner walls 104*a*, 104*b* in the top/bottom starter trim strips 100 as shown in FIG. 6A), with the inner wall sandwiched between the backside of the panel 12 and the top surface of the furring channel central base portion 20. Preferably, the trim strips are dimensioned such that ends of horizontally extending trim strips can fit within vertically oriented trim strips, with a small gap between them, which also facilitates the entry of drying air behind the panels.

As further illustrated in FIG. 6A-6H, foam inserts 110—e.g., made from closed-cell foam—can be inserted into the channels formed by the various trim strip profiles. These foam inserts 110 help to seal the edges of the panels against the entry of moisture behind the panels. Additionally, given their resilience, the foam inserts 110 can help center the panels 12 between opposing trim strips located at opposite edges of the panels 12.

Figure 7A:
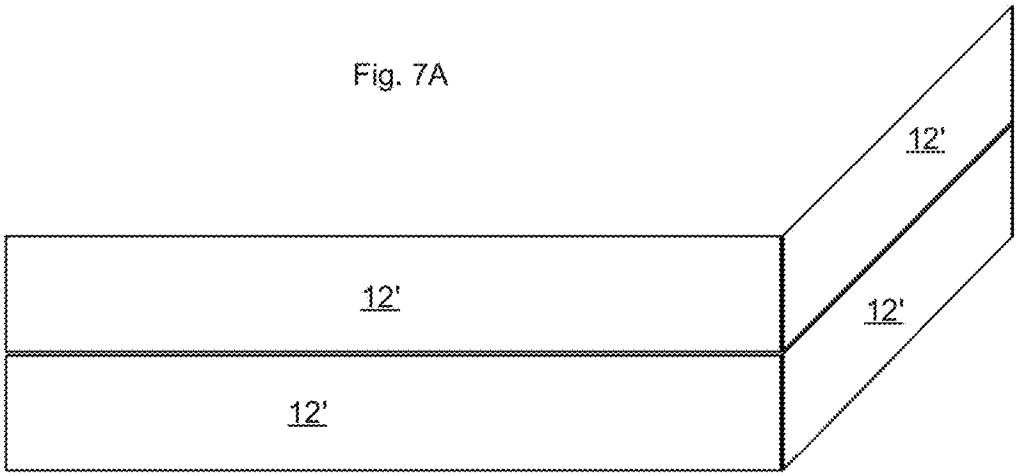
FIGS. 7A and 7B are a schematic perspective view and a schematic plan view, respectively, illustrating a panel arrangement designed to simulate an ACM (aluminum composite material) panel installation, with FIGS. 8A and 8B illustrating sequentially the stackup of two trim profiles that could be used to finish the panel arrangement shown in FIGS. 7A and 7B.
Figure 7B:
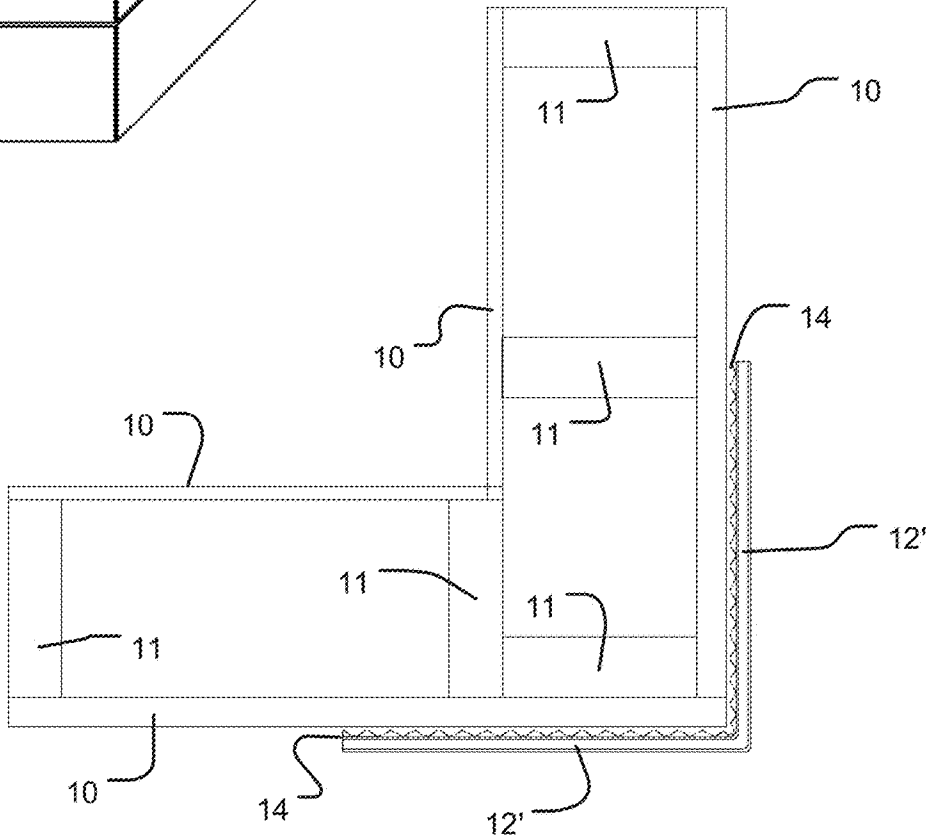
Figure 8B:
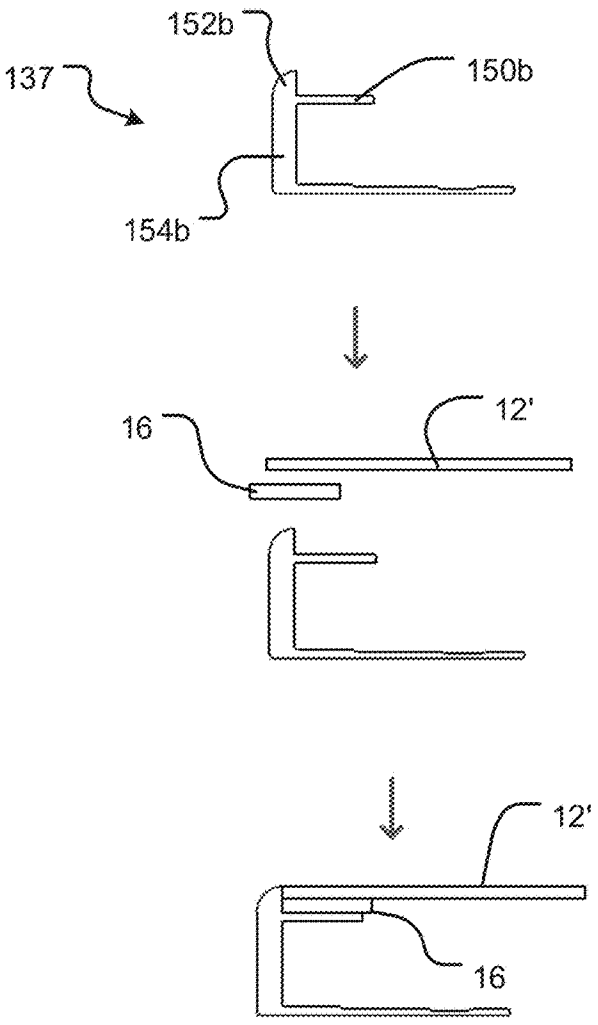
Figure 8A:
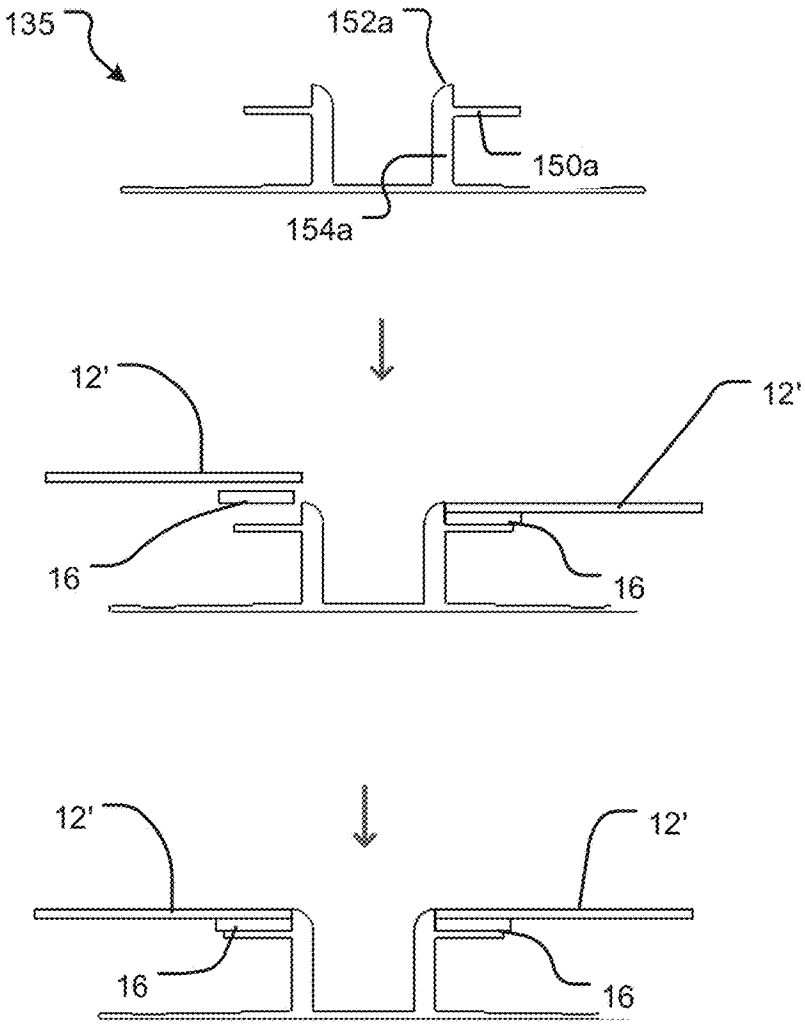

Another set of trim profiles, useful in connection with panels 12' that are designed to appear similarly to ACM (aluminum composite material) panels as illustrated in FIGS. 7A and 7B, are illustrated in FIGS. 8A and 8B (double-reveal and no reveal, respectively). As illustrated in FIGS. 7A and 7B, ACM-style panels 12' are designed to present a smooth, continuous exterior appearance. Toward that end, metal panels 12' with attached furring channels 14 can be bent on location at a jobsite and attached as described above to rail brackets 18 that have been mounted to adjacent wall structures 10 (supported by studs 11 or other framing structure) that meet each other at either exterior or interior corners.

To maintain the smooth appearance of the sheathing, the trim strips 135, 137 do not have a slotted front-leg configuration as in the trim profiles illustrated in FIGS. 6A-6H described above. Rather, there is just a single leg 150*a* or 150*b* that is that is set back from the free end 152*a* or 152*b* of the bridge segment 154*a* or 154*b* by a distance essentially equal to the combined thickness of the metal panel 12' and tape 16, and the free end 152*a* or 152*b* of the bridge segment 154*a* or 154*b* is rounded off so that the surface of the panel 12' transitions smoothly to the outer-facing surface of the bridge segment of any trim strip used to finish the assembly. Such a trim profile may be used to close off vertical edges or horizontal edges of the panels, e.g., with a double reveal configuration as illustrated.

Figure 9:
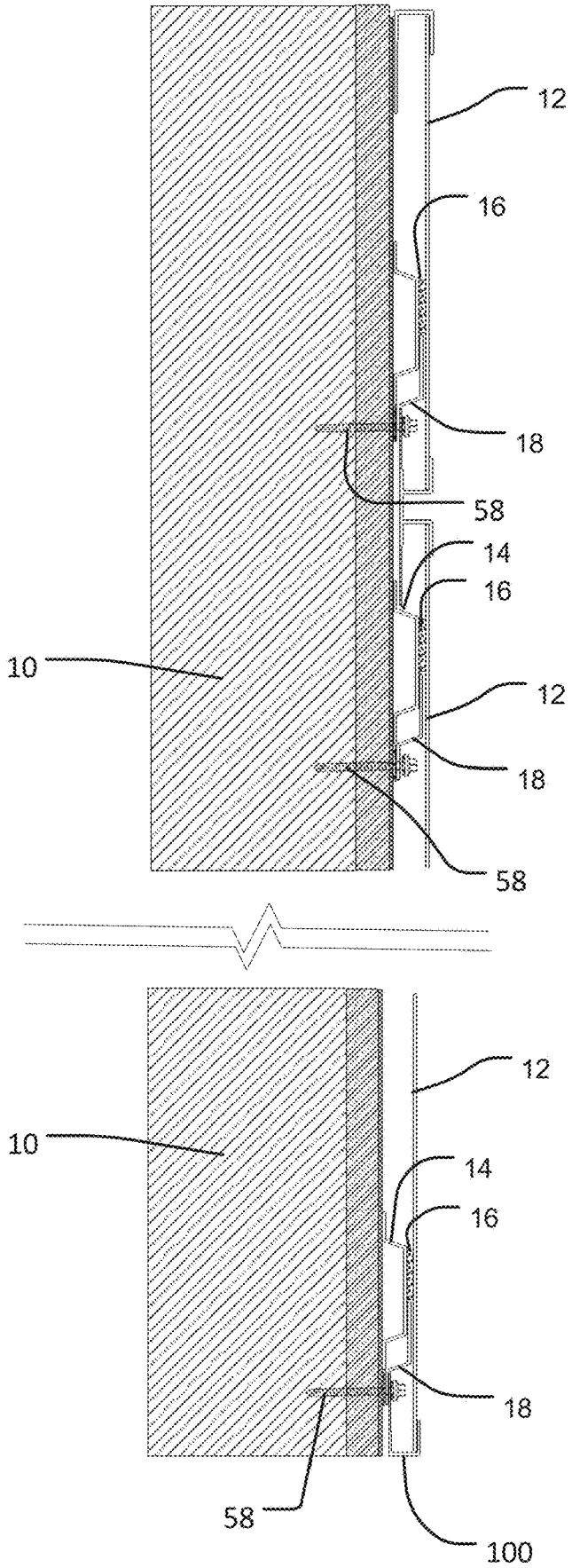
FIG. 9 is a schematic side view illustrating a sheathing arrangement designed to reduce installation time and cost.

In another approach to installation designed to save time and supplies (e.g., fasteners), which is illustrated in FIG. 9, a rail bracket 18 can be placed against the wall structure 10 and held in position, and then a trim strip 100 can be positioned below the rail bracket 18 with the long leg portion of the trim strip 100 overlapping the base portion 50 of the rail bracket 18. If a panel 12 has already been mounted to the wall structure 10 below the location where the rail bracket 18 and trim strip 100 are to be mounted, the trim strip 100 can be slipped down over the upper, free edge of the lower panel 12 to cover it, so that a lower long leg of the trip strip 100 overlaps the corrugated flange of a furring channel 14 that supports the lower panel 12, and then the upper half of the trim strip 100 rotated toward the wall structure so as to overlap the base portion 50 of the to-be-mounted rail bracket 18. This overlapped arrangement of the rail bracket 18 and trim strip 100 can then be secured to the wall structure by a single line of fasteners 58, which pass through both the long leg portion of the trim strip 100 and the base portion 50 of the rail bracket 18 and then into the wall structure 10. Then, when (another) panel 12 with a supporting furring channel 14 attached near its lower edge is mounted to the newly mounted rail bracket 18, the lower edge of the panel 12 will slide into position within the trim strip 100 as the lower corrugated flange 24 of the furring channel 14 slides into position behind the free flange 52 of the rail bracket 18.

Advantageously, this configuration creates a drainage space for moisture and airflow to flow up the entire wall through the corrugated flanges. Additionally, it allows an installation to "float" over imperfect walls and, if needed, an installer can use shims to straighten out a wall.

Figure 10:
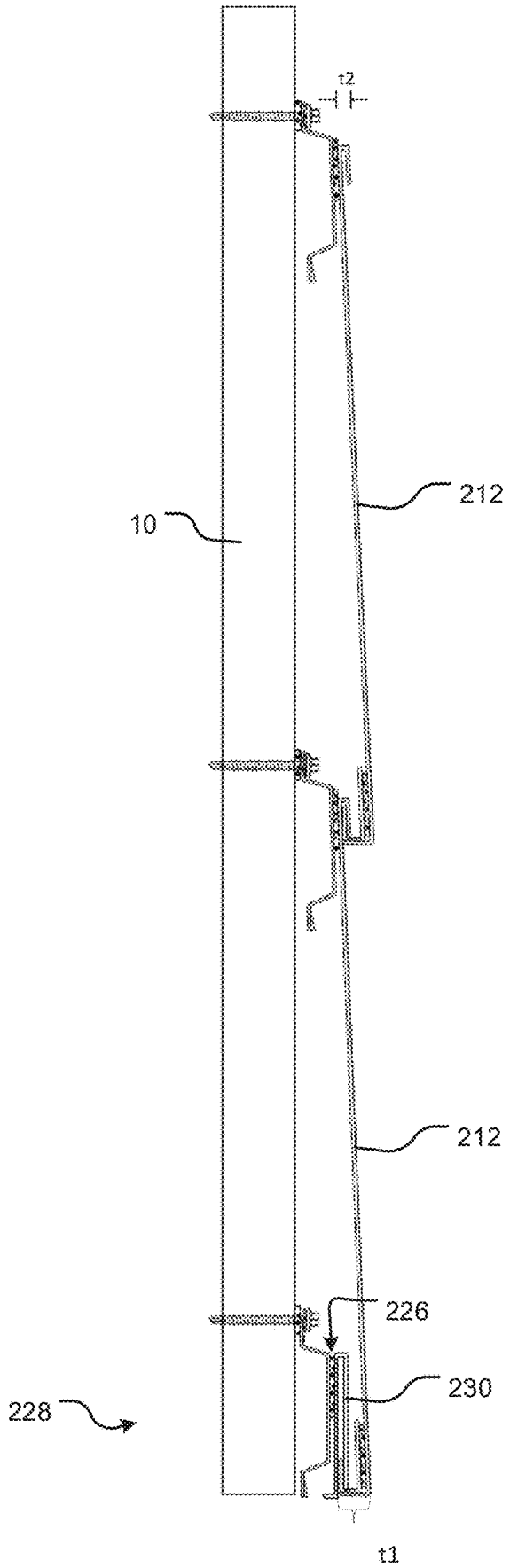
FIG. 10 is a schematic side view illustrating a clapboard arrangement of panels, with FIGS. 10A and 10B being enlarged views of components used in the arrangement shown in FIG. 10.
Figure 10A:
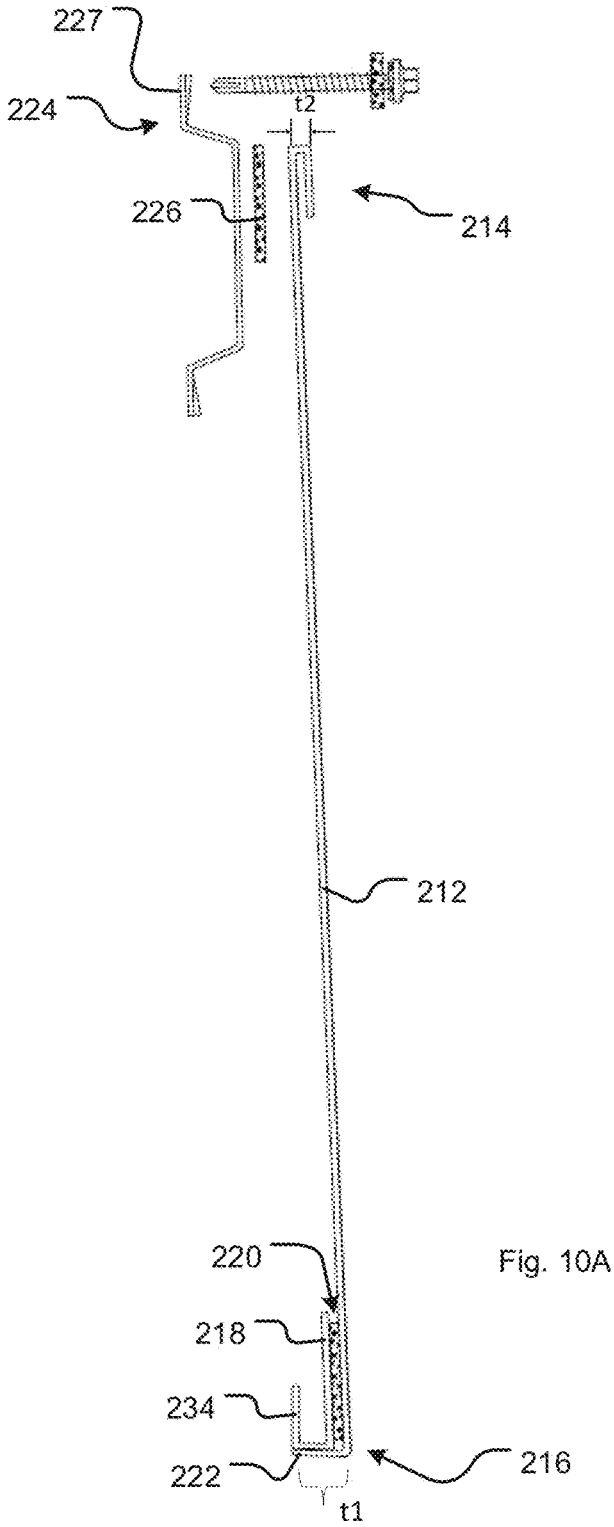
Figure 10B:
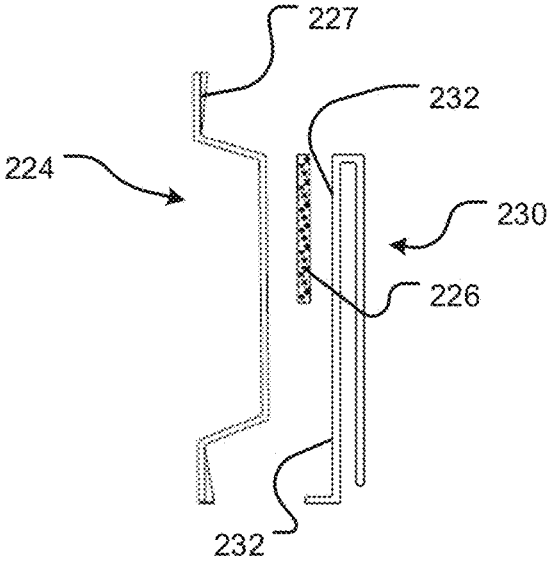
Figure 11:
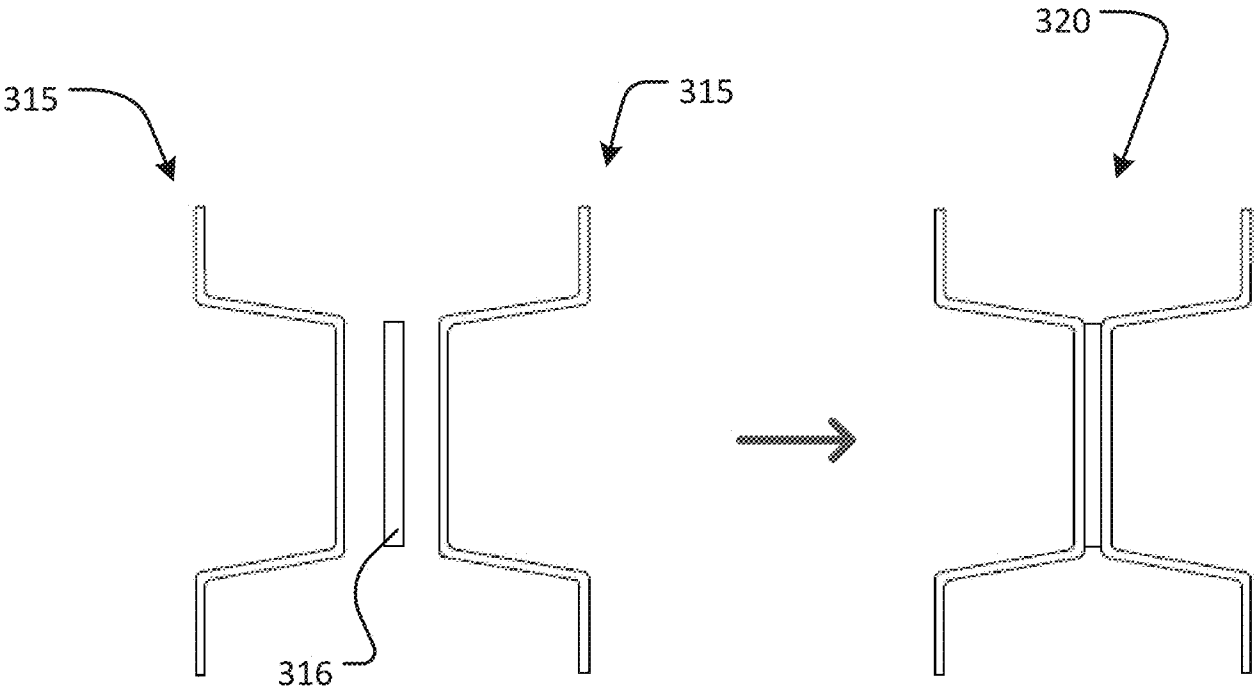
FIG. 11 is a schematic view illustrating the formation of structural I-beams from corrugated furring channels.

Inventive concepts that have been described above can also be incorporated into a clapboard arrangement of panels (e.g., siding panels 212) and trim strips as illustrated in FIGS. 10, 10A, and 10B. In this embodiment, the siding panels 212 are generally longer in the horizontal direction and narrower in the vertical direction than the panels 12 used in the embodiments described above. Overall, the panels 212 have a "double-hooked" cross-sectional profile, with an outwardly folded-over top edge that forms a top hook 214 and in inwardly folded-under bottom edge that forms a stand-off bottom hook 216. The overall thickness $t_1$ of the bottom hook 216 is greater than the overall thickness $t_2$ of the top hook 214, which helps angle the panels 212 away from the wall structure 10 with their lower edges farther away from the wall structure 10 than their upper edges are.

As illustrated, the bottom hook 216 may be formed by bending the lower edge of the sheet of material used to form the panel 212 by about ninety degrees, and then securing an extruded J-channel 218 to the backside of the sheet of material, in the corner between the front face of the panel 212 and the bent-under portion 222, using a length of high-bond-strength tape 220. Such a configuration, which locally doubles the wall thickness of the panels 212, enhances durability of the panels—particularly in a region that is more susceptible to damage (e.g., hail damage) than other regions of the panels. Alternatively, the bottom hook 216 could be formed from a single "ply" of material simply by double-bending the sheet of material used to form the panel 212.

A single corrugated furring channel 224, which is like the corrugated furring channels 14 described above, is attached to the backside of each panel 212 near the upper edge thereof, e.g., with the upper corrugated flange 227 of the furring channel 224 being positioned slightly above or outward relative to the uppermost edge of the panel 212. Like the furring channels 14, the furring channels 224 may be attached to the backsides of the panels 212 using very-high-bond double-sided tape 226, such as 3M B90F or 3M B16F available under the 3M™ VHB™ line of tape products.

To clad a wall structure 10 using the clapboard panels 212, a first corrugated furring channel 224 is attached horizontally to the wall structure 10 at the lowest point to be covered with the clapboard arrangement, as at location 228, using fasteners such as self-tapping screws, and a length of tape 226 is applied to the outer-facing surface of the central base portion of the furring channel 224. (The tape 226 may have been pre-applied to the central base portion of the furring channel 224.) Suitably, just a single row of fasteners is used along the uppermost corrugated flange 227 of the first corrugated furring channel to attach the furring channel to the wall structure, to permit the furring channel to pivot slightly relative to the wall structure. A clip-shaped starter hem/vent 230 is attached to the upturned leg 234 of the lower hook 216, and a back, mounting surface 232 of the starter hem/vent 230 is pressed into bonding contact with the length of tape 226 extending along the central base portion of the furring channel 224. The upper edge of the panel 212 is then pivoted toward the wall structure 10 until the upper flange 227 of the furring channel 214 at the top of the panel 212 contacts the surface of the wall structure. The panel 212 is then fastened to the wall structure using another row of fasteners extending through the upper flange 227 that extends past the upper edge of the panel 212.

Subsequent panels 212 are installed, moving upwardly, by hooking the upturned leg 234 of the lower hook 216 of the next panel 212 into the upper hook 214 of a previously installed panel 212; pivoting the upper edge of the panel 212 toward the wall structure; then securing the upper flange 227 of the furring channel 224 that is at the top of the next panel to the wall structure using a line of fasteners passing through the exposed corrugated flange. A covering trim strip (not illustrated) may then be secured to the wall structure above the exposed upper flange of the uppermost panel to complete the assembly.

Because the lower ends of the panels 212 protrude farther away from the wall structure than the upper ends of the panels do, and because this distance tends to be somewhat greater than the distance the above-described panels 12 are spaced from the wall structure, trim strips for use with a clapboard arrangement of panels will tend to have slightly wider channels than those that are illustrated in FIGS. 1 and 6A-6H and described above.

As in the case of the trim strips illustrated in FIGS. 6A-6H, the trim strips may have foam inserts that help seal off and center the panels 212 horizontally between opposing vertical trim strips. Further still, to help retain the foam inserts, bracket-shaped U-channels could be inserted into J-channel portions of the trim strips in covering relation to the foam inserts. Because the foam inserts are resilient, and because the U-channels can slide relative to the J-channel portions of the trim strips, the U-channels will bear snugly against the edges of the panels to seal the channel and prevent water from entering behind the siding. On the other hand, the wider flange of these trim strips will help divert water away from the openings.

Figure 12B:
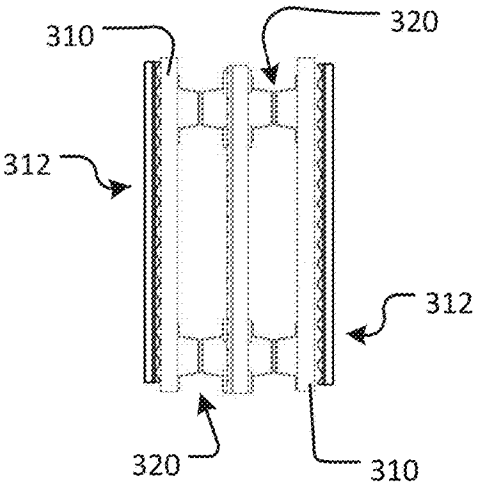
FIGS. 12A-12D are schematic views illustrating the use of such structural I-beams in various wall construction arrangements.
Figure 12D:
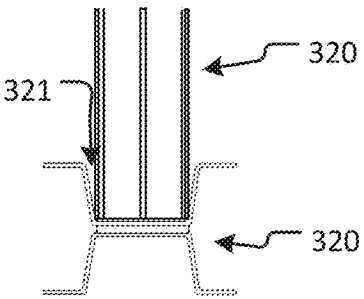
Figure 12A:
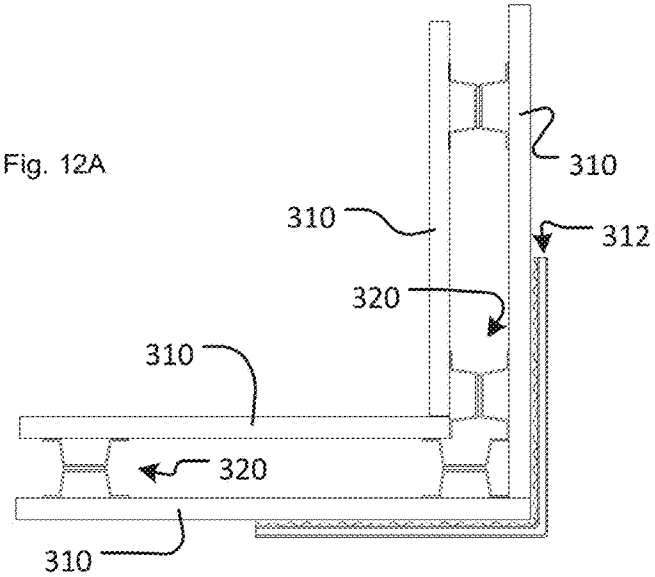
Figure 12C:
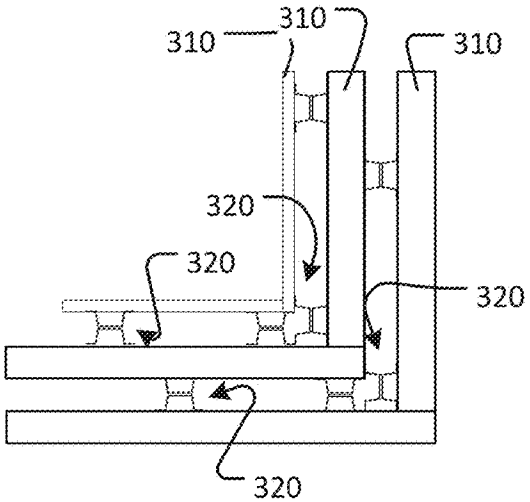

Furthermore, corrugated furring channels as described above can be utilized to construct different structural members altogether—namely, structural I-beams 320 that can be used as studs, sills, cap plates, etc., as illustrated in FIGS. 11 and 12A-12D. The I-beams 320 are formed by joining together pairs of furring channels 315 in back-to-back fashion, with strips of very-high-bond tape 316 sandwiched between the central base portions of the furring channels that are brought together as shown. Wall structures 310 can then be positioned against the corrugated flanges of the furring channels 315 and fastened to them, e.g., using self-tapping screws extending through the wall structures. The wall structures 310 can be plywood, drywall, continuous insulation panels, etc., and composite furring channel/metal panel assemblies 312 can be attached to the wall structures 310 utilizing any of the techniques described above. If desired, I-beams 320 can also be used as sills, as illustrated in FIG. 12D, or cap plates (not illustrated), with ends of vertical structural members (e.g., I-beams 320 used as studs) fitting within the concavities 321 of the sills and/or cap plates. Given the corrugated nature of the I-beam flanges formed from the flanges of the furring channels 315, excellent intra-wall circulation can be obtained, and the I-beams 320 have excellent strength-to-weight characteristics.

In the embodiments described above, furring channels with a hat-shaped profile and corrugated flanges are attached to the rear surfaces of panels, siding, etc. (referred to generically as panels), that are to be attached to the surface of a wall. The furring channels are attached horizontally to the panels using thick, high-bond-strength tape such as 3M B90F or 3M B16F, with the central web of the hat-shaped profile attached to the rear surface of the panel using the high-bond-strength tape; the legs of the hat-shaped channel extending away from the rear surface of the panel; and the out-turned corrugated flanges of the hat-shaped profile being free edges.

Furthermore, a rail bracket with a Z-shaped profile is attached to the wall, e.g., using a self-drilling screw passing through one flange of the Z-shaped profile and with the central web and the other flange of the Z-shaped rail bracket extending upwardly and away from the wall, i.e., to provide a free edge. (Suitably, a length of the thick, high-bond-strength tape is applied to the surface of the flange that faces the wall to space the rail bracket slightly away from the wall and to form a gasket seal around the shank of the screw passing through the flange and into a mounting point within or behind the wall (e.g., a stud).) The panels are then attached to the wall by fitting the downwardly extending legs/corrugated free edges of the hat-shaped furring channels behind the upwardly extending web/free edge of the rail bracket. See, for example, FIG. 2. This yields a cladded structure in which the panels "float" to some extent relative to the wall; no fasteners pass through the panels to join them to the wall, thereby eliminating points of entry through which moisture could otherwise invade behind the panels; and in which the corrugated flanges of the furring channels provide spaces through which moisture that does get behind the panels can drain and through which moisture-drying air can circulate.

Figure 17:
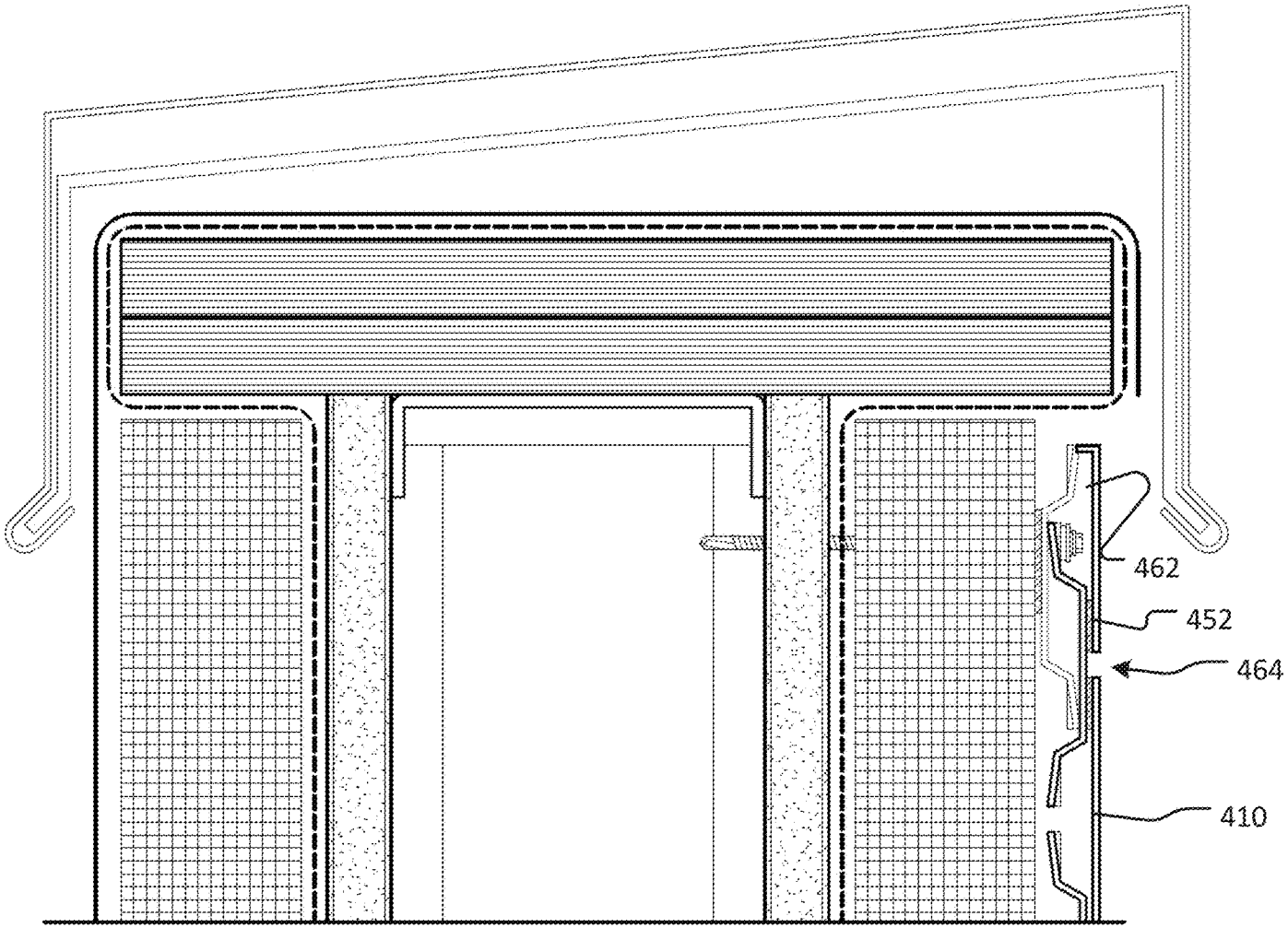
FIG. 17 is a schematic side section view illustrating upper portions of the wall illustrated in FIG. 16.
Figure 18:
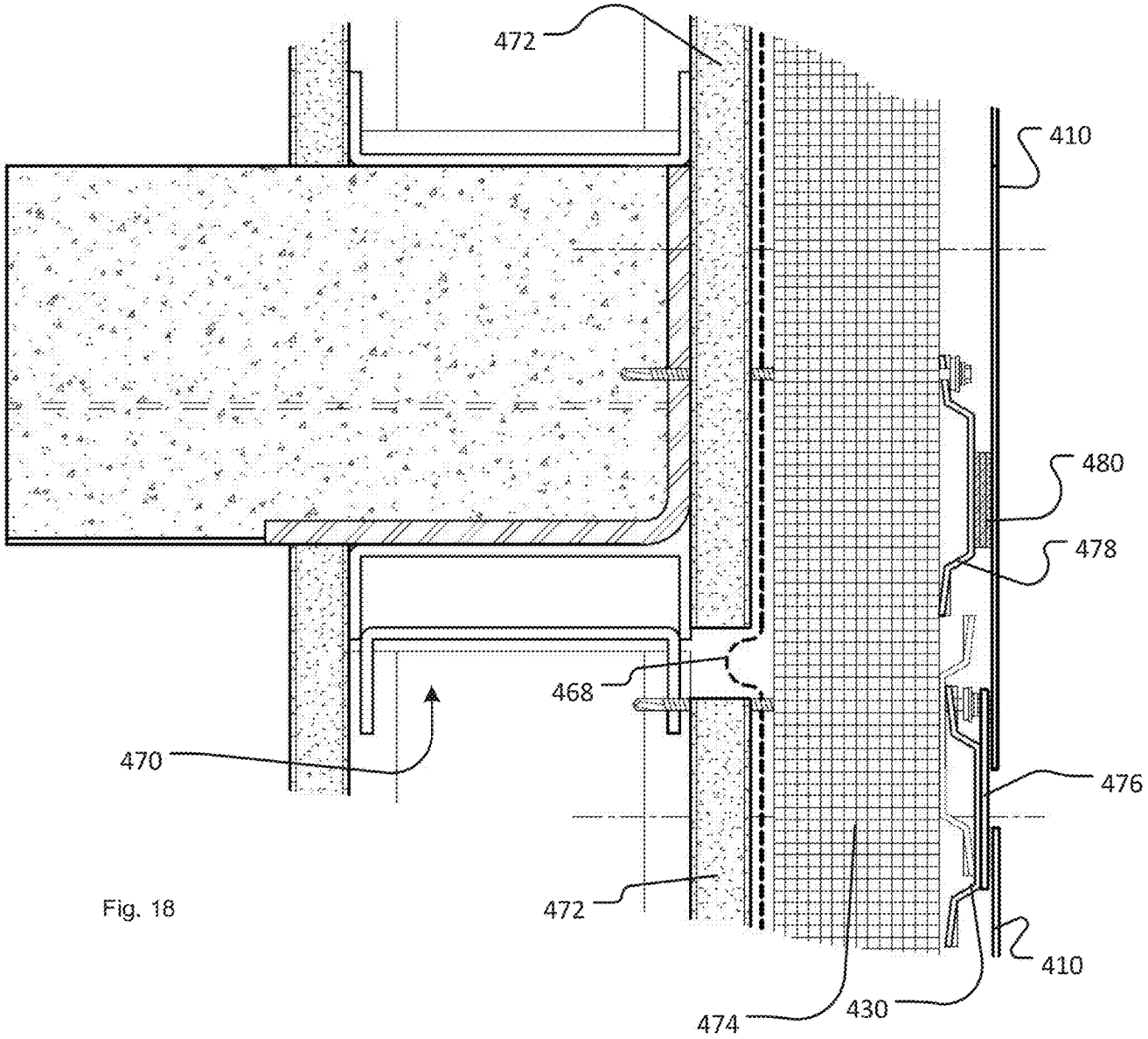
FIG. 18 is a schematic side section view illustrating an expansion joint in a wall as illustrated in FIG. 16.
Figure 19:
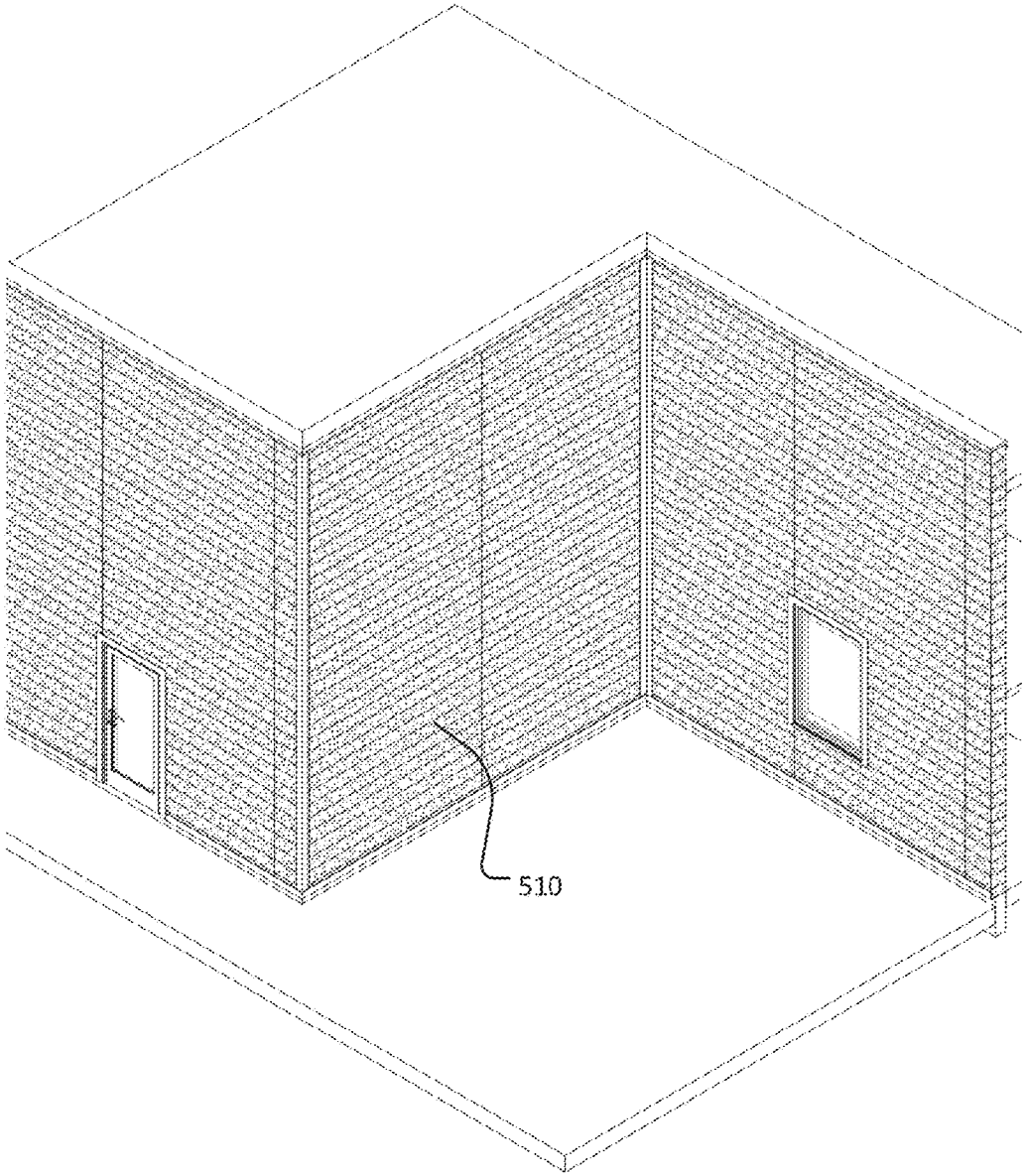
FIG. 19 is a schematic perspective view illustrating a clad building using a still further embodiment of a wall sheathing system in accordance with the claimed invention.
Figure 20:
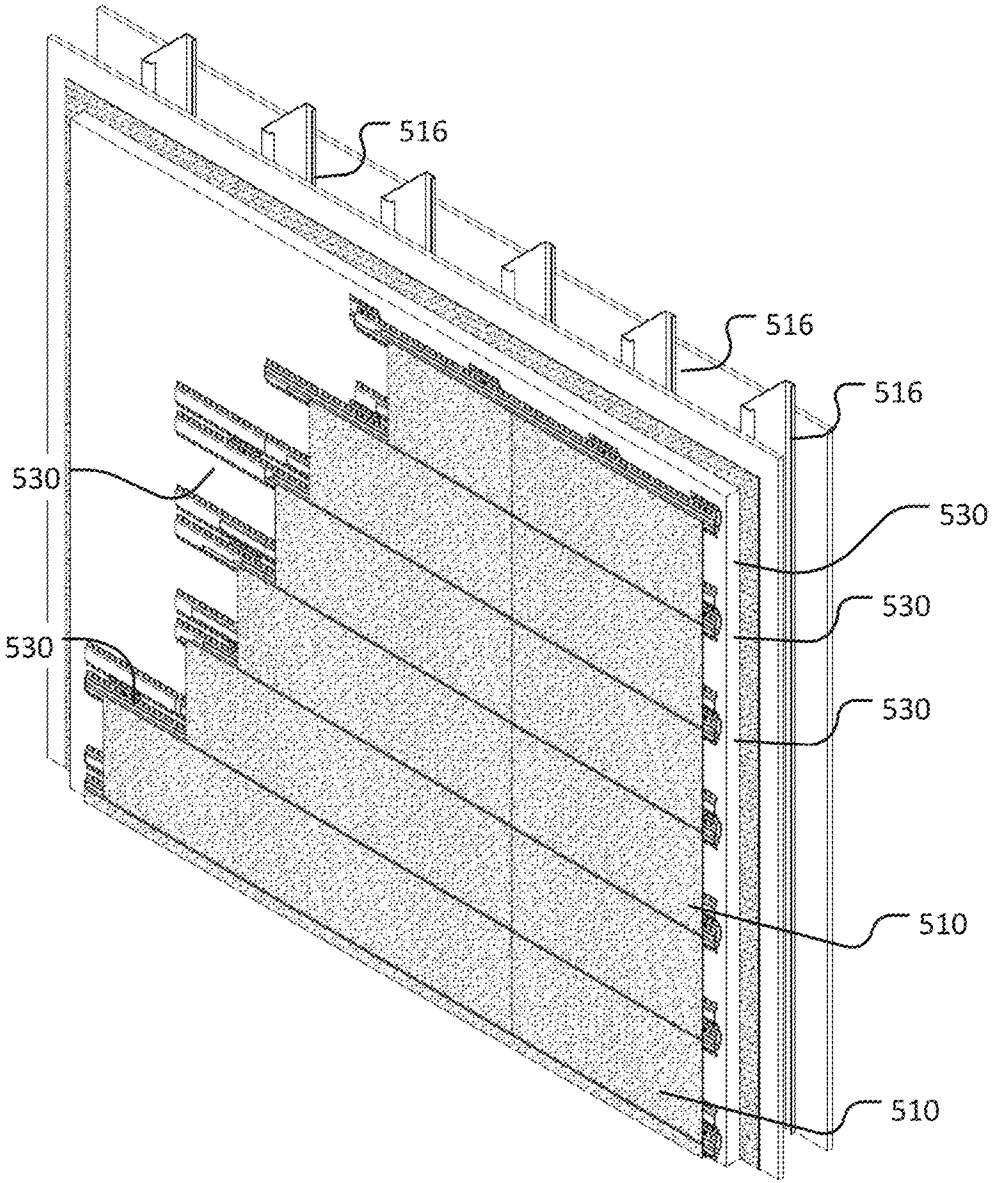
FIG. 20 is a schematic perspective view illustrating a wall clad using the embodiment of a wall sheathing system illustrated in FIG. 19.
Figure 21:
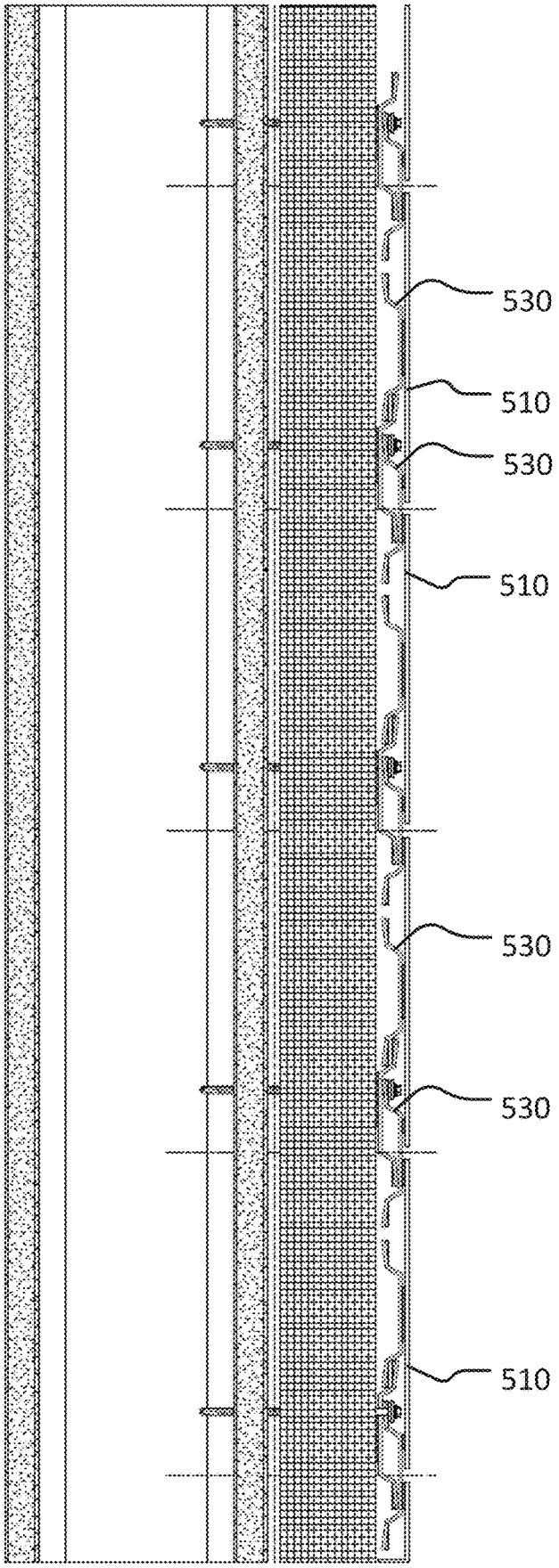
FIG. 21 is a schematic side section view illustrating the wall clad using the embodiment of a wall sheathing system illustrated in FIG. 19.
Figure 22:
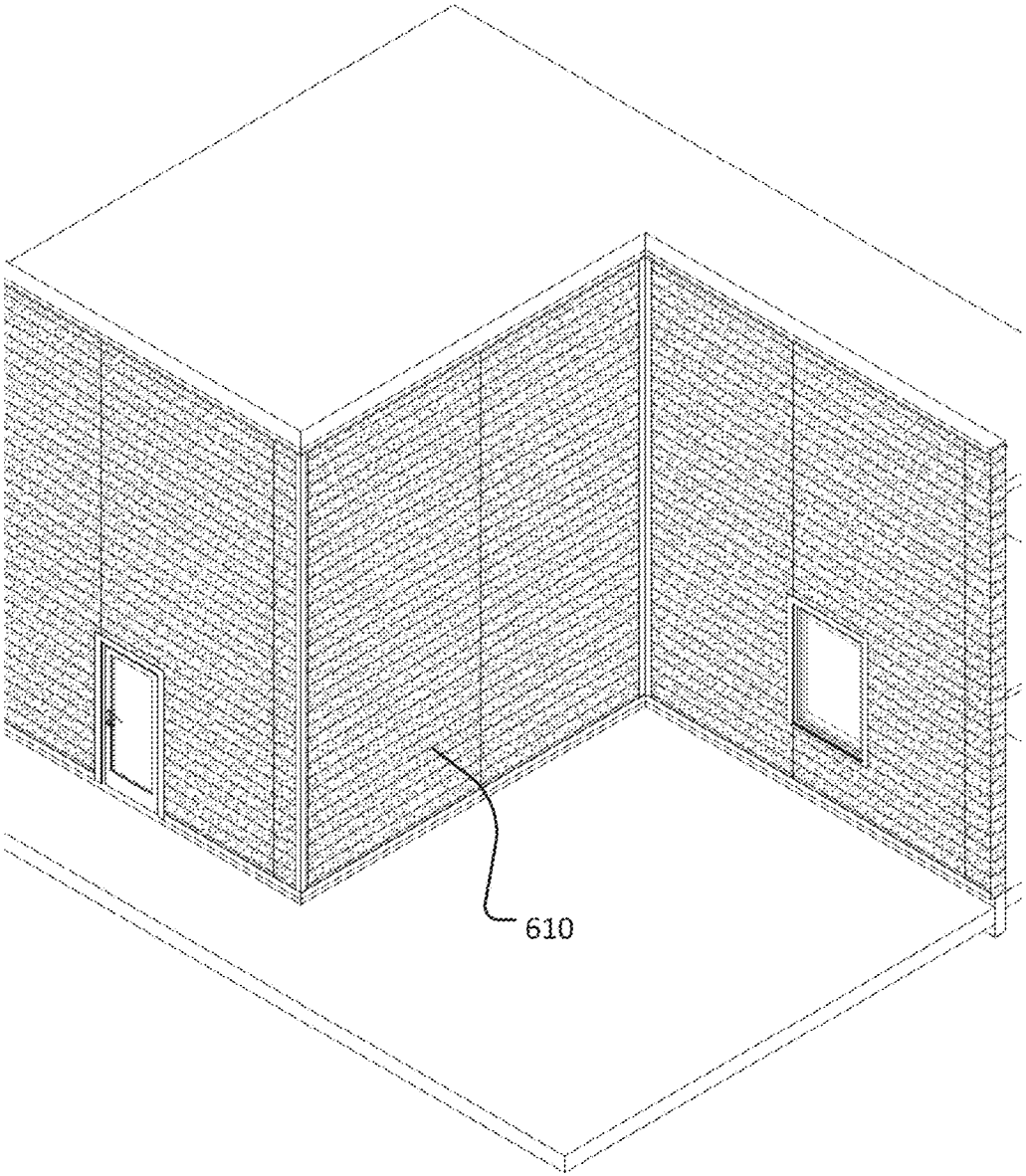
FIG. 22 is a schematic perspective view illustrating a clad building using a still further embodiment of a wall sheathing system in accordance with the claimed invention.

In further embodiments, short segments (e.g., 6-8 inches long) of corrugated hat-shaped furring channel are used as the mounting brackets attached to the surface of the wall at each mounting point (e.g., stud locations). For these additional embodiments, basic concepts for cladding or sheathing a building are illustrated in FIGS. 13-18 for large panels 410 in general (e.g., panels on the order of eight to twelve feet long by one to four feet high); FIGS. 19-21 for narrower, plank-shaped panels 510; and FIGS. 22-27 for plank-shaped panels 610 arranged in overlapping fashion, as in conventional (residential) siding.

Figure 13:
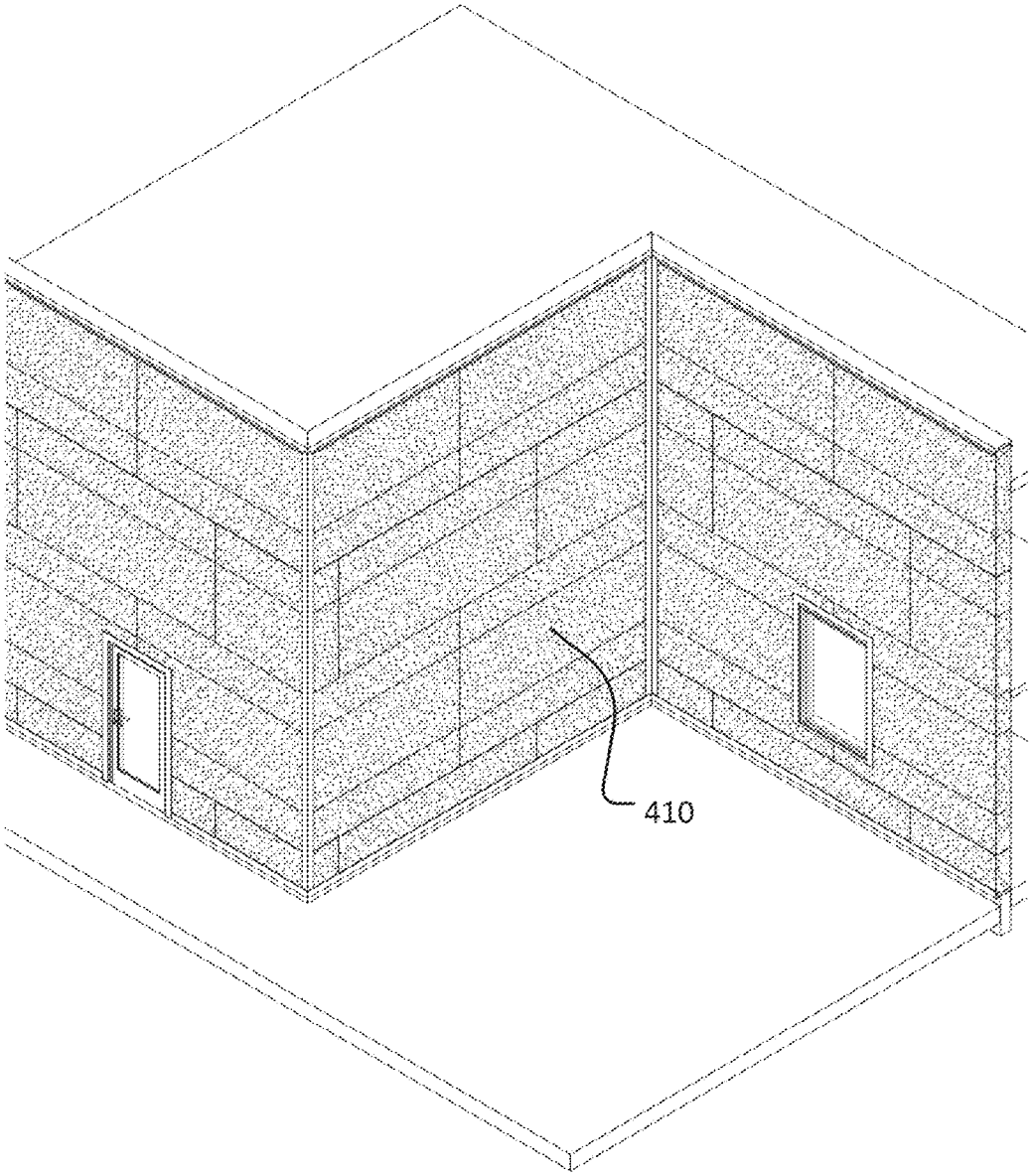
FIG. 13 is a schematic perspective view illustrating a clad building using another embodiment of a wall sheathing system in accordance with the claimed invention.

FIG. 13 illustrates in a general manner a building that is sheathed or clad with panels 410 of various shapes and sizes, along with various building features in connection with which the inventive system may be used such as doorways, windows, inside corners, outside corners, etc. The embodiment of an inventive cladding system illustrated in FIG. 13 is illustrated in greater detail in FIGS. 14, 14A, 15, 16, 16A, 16B, 16C, and 17. As illustrated in these figures, mounting brackets 412 are secured to a wall structure at numerous locations across the surface of the wall structure, e.g., via self-tapping screws 414 which extend into the studs 416 of the building. Depending on the specific design of the building, the cladding could be mounted over continuous insulation (i.e., thick, semi-rigid sheets of foam-type insulation) or directly to wall material such as exterior sheetrock or plywood. The mounting brackets 412 suitably are made from short lengths (e.g., 6 to 8 inches long) of hat channel-shaped corrugated furring channels, e.g., FM3-VHV™ structural rainscreen furring available from AlBuild Systems, LLC of Omaha, Nebr.

Figure 16:
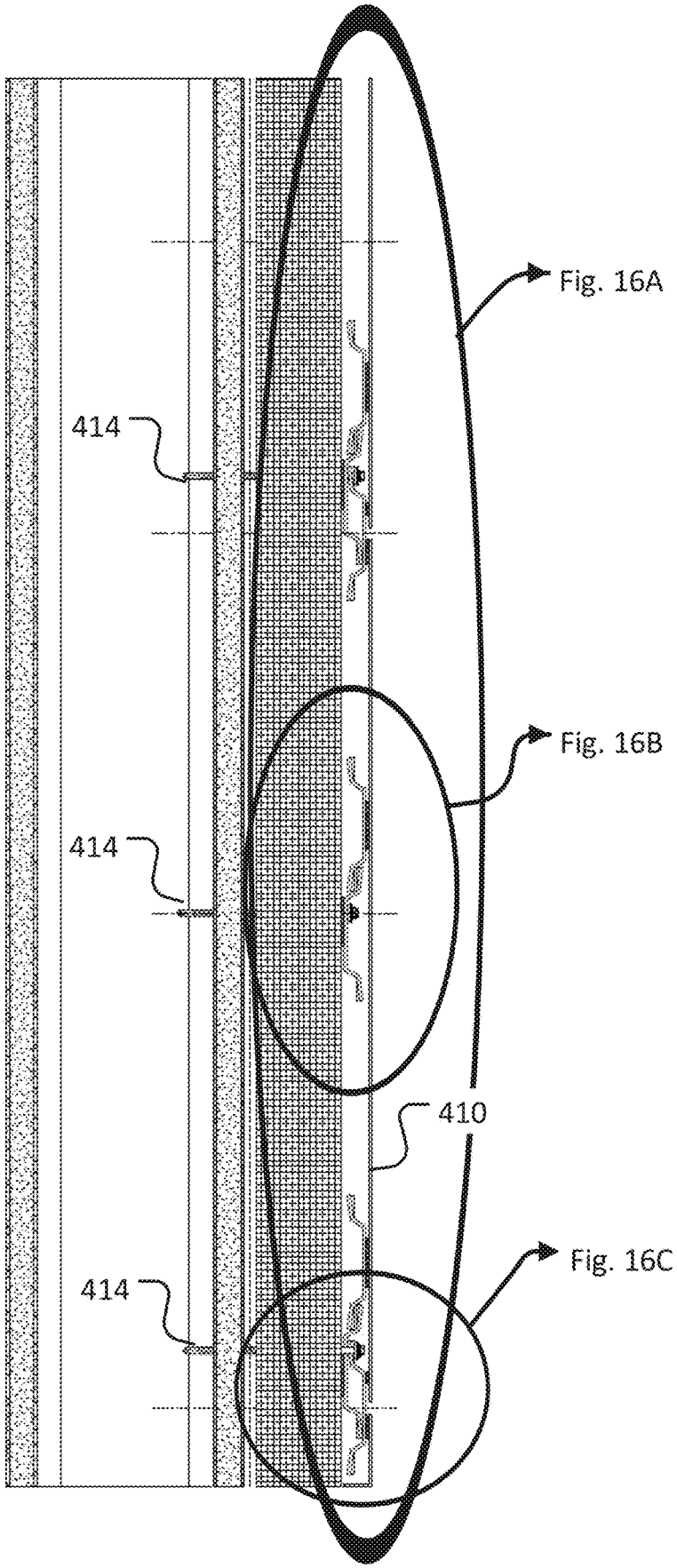
FIG. 16 is a schematic side section view illustrating a wall clad using the embodiment of a wall sheathing system illustrated in FIG. 13, with FIGS. 16A, 16B, and 16C being enlarged views of the circled portions in FIG. 16.
Figure 16A:
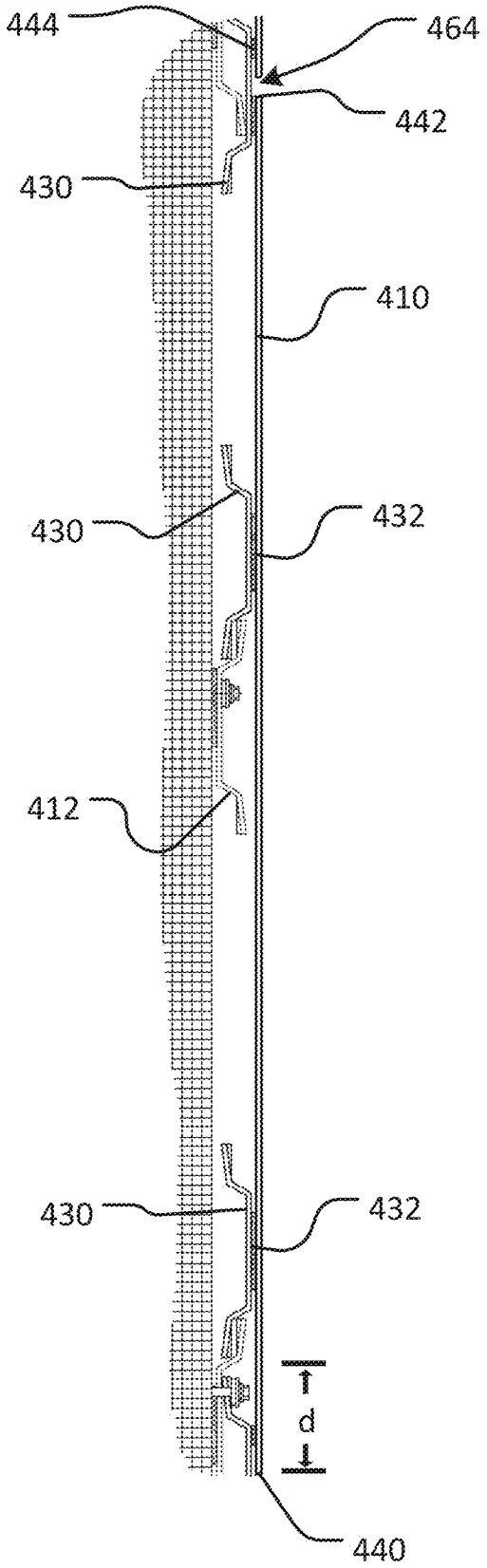
Figure 16B:
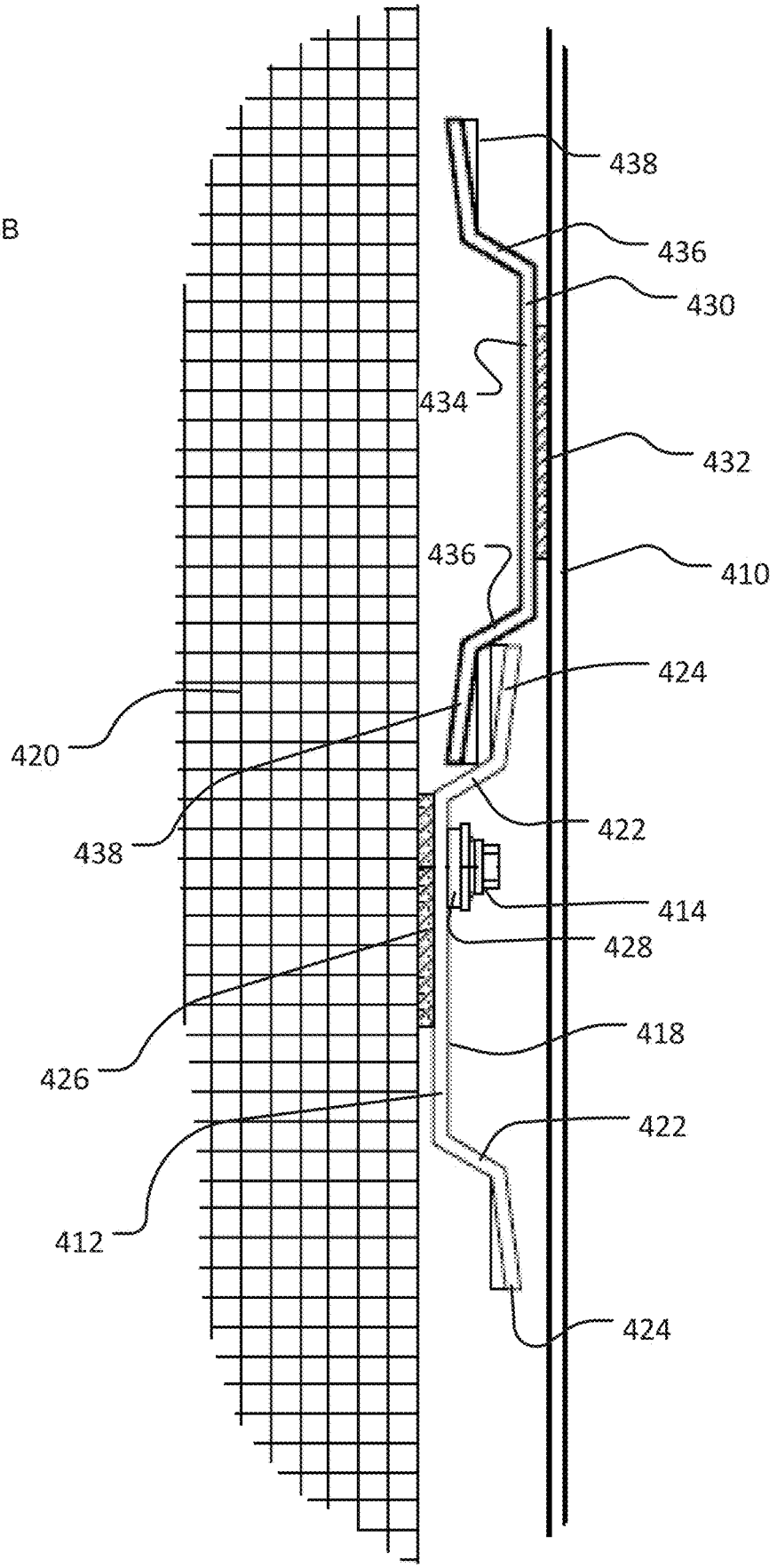

As illustrated most clearly in FIG. 16B, the web 418 of each mounting bracket 412 is positioned closest to the wall structure 420, with legs 422 extending away from the wall structure 420 in an upwardly angling direction and in a downwardly angling direction and corrugated flanges 424 spaced away from the surface of the wall structure 420. Suitably, a segment of very high bond-strength tape 426 such as 3M B90F or 3M B16F is attached to the wall-facing surface of the web 418 and may or may not be adhered to the surface of the wall structure 420 (i.e., by removing the release liner (not illustrated) that covers the surface of the tape before it is applied to the surface). Advantageously, the segment of high bond-strength tape 426 spaces the mounting bracket 412 from the surface of the wall structure 420, which creates a thermal break between the system of panels 410 that are mounted to the wall structure 420 via the inventive cladding system and which further improves drainage of moisture from behind the panels 410 and drying circulation of air behind the panels 410. Additionally, although the self-tapping screws 414 suitably are gasketed screws (i.e., they have sealing gaskets 428 pre-installed around the shank of the screw just below the head of the screw), the segment of high bond-strength tape 426 will also form a seal around the shank of the screw 414 to help prevent moisture from seeping into the wall structure 420.

Additionally, two or more—e.g., three, as illustrated in FIGS. 16 and 116A—hat channel-shaped corrugated furring channels 430 (e.g., FM3-VHV™ structural rainscreen furring available from AlBuild Systems, LLC of Omaha, Nebr.) are attached to the rear surface of each of the panels 410 (i.e., the surface that faces toward the wall structure 420). Like the mounting brackets 412, the furring channels 430 have a web 434, with legs 436 extending away from the web 434 in an upwardly angling direction and in a downwardly angling direction and corrugated flanges 438 spaced away from the web 434. The furring channels 430 are attached to the panels 410 via their webs 434 using strips 432 of very high bond-strength tape such as 3M B90F or 3M B16F. The furring channels 430 may extend across the entire width of the panels 410, and they are used to mount the panels 410 to the wall structure 420 via the mounting brackets 412.

As illustrated in the various figures, the panels 410 are mounted to the wall structure 420 by "hooking" the lower, downwardly extending corrugated flanges 438 of the corrugated furring channels 430 behind the upper, upwardly extending corrugated flanges 424 of the mounting brackets 412. Furthermore, the corrugated furring channels 430 are attached to the rear surfaces of the panels 410 at positions that facilitate installing the panels starting at the bottom of the wall structure 420 and working one's way up. As shown in FIG. 16A, the lowermost furring channel 430 on each panel 410 may be spaced upwardly from the lower edge 440 of the panel 410 by a distance d on the order of five or six inches, which is about the same as the vertical width of the furring channels 430 (from the edge of one corrugated flange 438 to the edge of the other corrugated flange 438) so that the lowermost furring channel 430 is completely concealed behind the panel 410. On the other hand, the uppermost furring channel 430 is attached to the rear surface of the panel 410 at a position such that approximately one half of the furring channel 430 (widthwise speaking) or a little more extends past the upper edge 442 of the panel 410, and a length of high bond-strength tape 444 that is attached to the web 434 of the uppermost furring channel 430 is (initially) exposed and accessible. If one is present, the middle furring channel 430 may be located approximately mid-way between the upper and lower furring channels 430 or mid-way between the lower and upper edges 440, 442 of the panel 410.

Figure 16C:
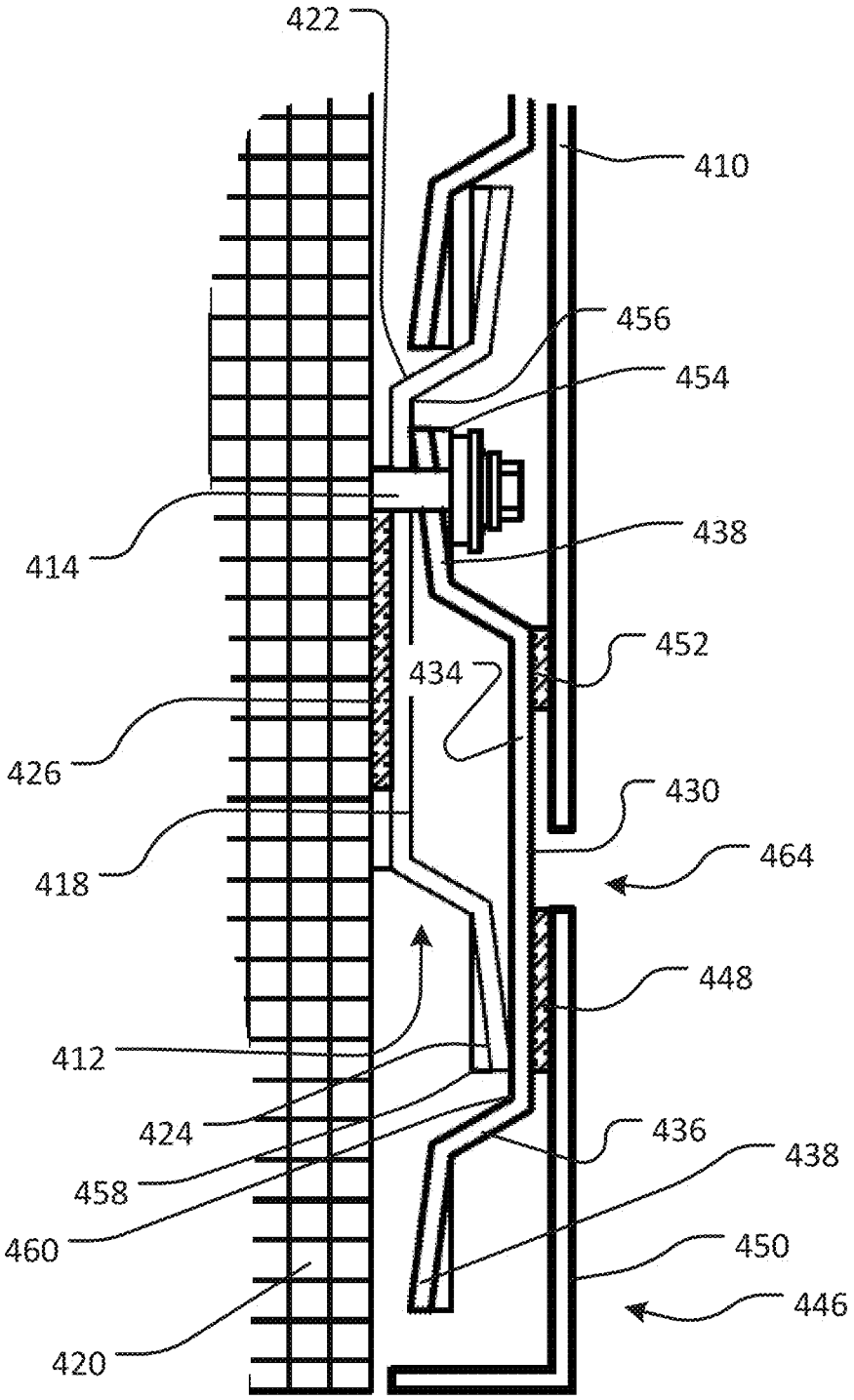

As shown in FIG. 16C, a starter unit 446 is provided to facilitate the beginning of installation of the panels 410 onto the wall structure 420. The starter unit 446 includes a furring channel 430 with an L-shaped trim piece 450 attached to the web 434 of the furring channel 430 via a length of very high bond-strength tape 448, with the L-shaped trim piece 450 extending downwardly and being bent under the lowermost corrugated flange 438 of the furring channel 430 to conceal the furring channel 430 from below. A second length of very high bond-strength tape 452 is also attached to the web 434 of the furring channel 430.

To attach the starter unit 446 to the wall structure 420, the mounting bracket 412 over which the starter unit 446 will be mounted may be attached semi-securely to the surface of the wall structure 420 by removing the release liner from the very high bond-strength tape 426 on the web 418 of the mounting bracket 412 and simply adhering the mounting bracket 412 to the wall structure 420. The starter unit 446 may then be positioned over the mounting bracket 412 in a "yin-and-yang" manner as shown, with the upper corrugated flange 438 of the corrugated furring channel 430 bearing against the web 418 of the mounting bracket 412 and the lower corrugated flange 424 of the mounting bracket 412 bearing against the web 434 of the corrugated furring channel 430. Self-tapping screw 414 is then driven through the upper flange 438 of the corrugated furring channel 430, the web 418 of the mounting bracket 412, the very high bond-strength tape 426 on the back surface of the mounting bracket web 418, and into the wall structure 420 (e.g., into a stud 416 behind or within the wall structure 420). Alternatively, depending on the length of the starter unit 446 and/or the availability of additional workers to hold the starter unit 446 level if needed, the mounting bracket 412 and the starter unit 446 can simply be held together by hand, placed against the wall structure 420 without removing the release liner on the very high bond-strength tape 426, and the self-tapping screw 414 driven through the flange 438, web 418, and into the wall structure 420.

Furthermore, it may be preferable to fabricate the mounting brackets 412 and the corrugated furring channels 430 from the same corrugated hat-channel stock, in which case their cross-sectional profiles will be identical. In that case, the corrugated furring channel 430 may be slid vertically relative to the mounting bracket 412 so that 1) the edge 454 of the upper corrugated flange 438 of the corrugated furring channel 430 engages with the inside corner 456 of the mounting bracket 412 where the upper leg 422 of the mounting bracket 412 meets the web 418 of the mounting bracket 412, and 2) the edge 458 of the lower corrugated flange 424 of the mounting bracket 412 engages with the inside corner 460 of the corrugated furring channel 430 where the lower leg 436 of the corrugated furring channel 430 meets the web 434 of the corrugated furring channel 430. This arrangement, with uniform cross-sections of the mounting brackets 412 and the corrugated furring channels 430 and edge-to-corner/edge-to-corner engagement of the furring channels 430 and the mounting brackets 412, facilitates "snug" or "tight" assembly of the sheathing system onto the wall structure 420, with relatively uniform spacing of components.

Once the starter unit 446 has been attached to the bottom of the wall structure 420, installation of panels 410 may proceed upwardly. If the panels 410 are wide enough (in the vertical direction) for them to include a middle corrugated furring channel 430 as illustrated in FIG. 16A, then a mounting bracket 412 may first be attached to the wall structure 420 to engage with the middle furring channel. This may be accomplished, for example, by measuring up a predetermined distance from the uppermost edge of the upper flange of the mounting bracket 412 that will be positioned lower than the middle corrugated furring channel 430 and attaching the mounting bracket 412 to the wall structure 420 at this location, e.g., by driving a self-tapping screw 414 through the web 418 of the mounting bracket 412 and into a stud 416. Then, the release liner for the second length of very high bond-strength tape 452 on the corrugated furring channel 430 of the starter unit 446 is removed; lower flanges of the lowermost corrugated furring channel 430 and middle corrugated furring channel (if present) are positioned behind the upper flanges of corresponding mounting bracket(s) 412; and the panel 410 is lowered such that the corrugated furring channel(s) 430 engage with the associated mounting bracket(s) 412 (e.g., as illustrated in FIG. 16B). At the same time, the lower portion of the panel 410 is pressed into bonding engagement with the second length of very high bond-strength tape 452 to form a seal between the lower portion of the panel 410 and the surface of the corrugated furring channel 430 (without using caulk, as is the case for the entire sheathing assembly).

Furthermore, it may be desirable to attach an upper mounting bracket 412 to the wall structure 420 to engage the uppermost corrugated furring channel 430 (attached to the panel 410) before the panel 410 is mounted to the wall structure 420. In that case, a predetermined distance may be measured up from the uppermost edge of a lower mounting bracket 412, as described above, to determine the appropriate location for the higher mounting bracket 412. The higher mounting bracket 412 may be attached semi-securely to the surface of the wall structure 420 by removing the release liner from the very high bond-strength tape 426 on its web and simply adhering the higher mounting bracket 412 to the wall structure 420, as described above. The panel 410 would then be mounted to the wall structure 420 by "hooking" the lower corrugated flange(s) of the lower furring channel(s) 430 attached to the panel 410 behind the corresponding upper flange(s) of the associated mounting bracket(s) 412; sliding the panel 410 down slightly and pressing its lower portion into bonding engagement with the second length of very high bond-strength tape 452 to form a seal between the lower portion of the panel 410 and the surface of the corrugated furring channel 430; and bringing the upper corrugated furring channel 430 (attached to the panel 410) into "yin-and-yang"-type engagement with the upper mounting bracket 412 (as described above with reference to the starter unit 446). A self-tapping screw 414 is then driven through the upper flange 438 of the uppermost corrugated furring channel 430, the web 418 of the upper mounting bracket 412, the length of very high bond-strength tape secured to the back side of the web 418, and into a stud 416 to secure the panel 410 to the wall structure 420.

Alternatively (as also described above with reference to the starter unit 446), the upper mounting bracket 412 can simply be held against the uppermost corrugated furring channel 430 on the back of the panel 410 by hand as the flanges of the lower furring channel(s) is/are hooked behind the corresponding flange(s) of lower mounting brackets 412 and the upper furring channel/upper mounting bracket assembly is pressed against the wall structure 420. A self-tapping screw 414 is then driven through the flange 438 of the uppermost corrugated furring channel 430, the web 418 of the upper mounting bracket 412, and into a stud within or behind the wall structure 420.

This process is then repeated, working up the wall until it is clad or sheathed with a column of panels 410. Once the highest desired elevation is reached, an L-shaped trim piece 462 is attached to the uppermost corrugated furring channel 430 extending out from under the uppermost panel 410 using the second length of very high bond-strength tape 452 on the web of the corrugate furring channel 430, as illustrated in FIG. 17. This "closes off" the installation and gives it a finished appearance. The process is repeated for adjacent columns, too, to cover the entire surface to be clad.

Figure 14:
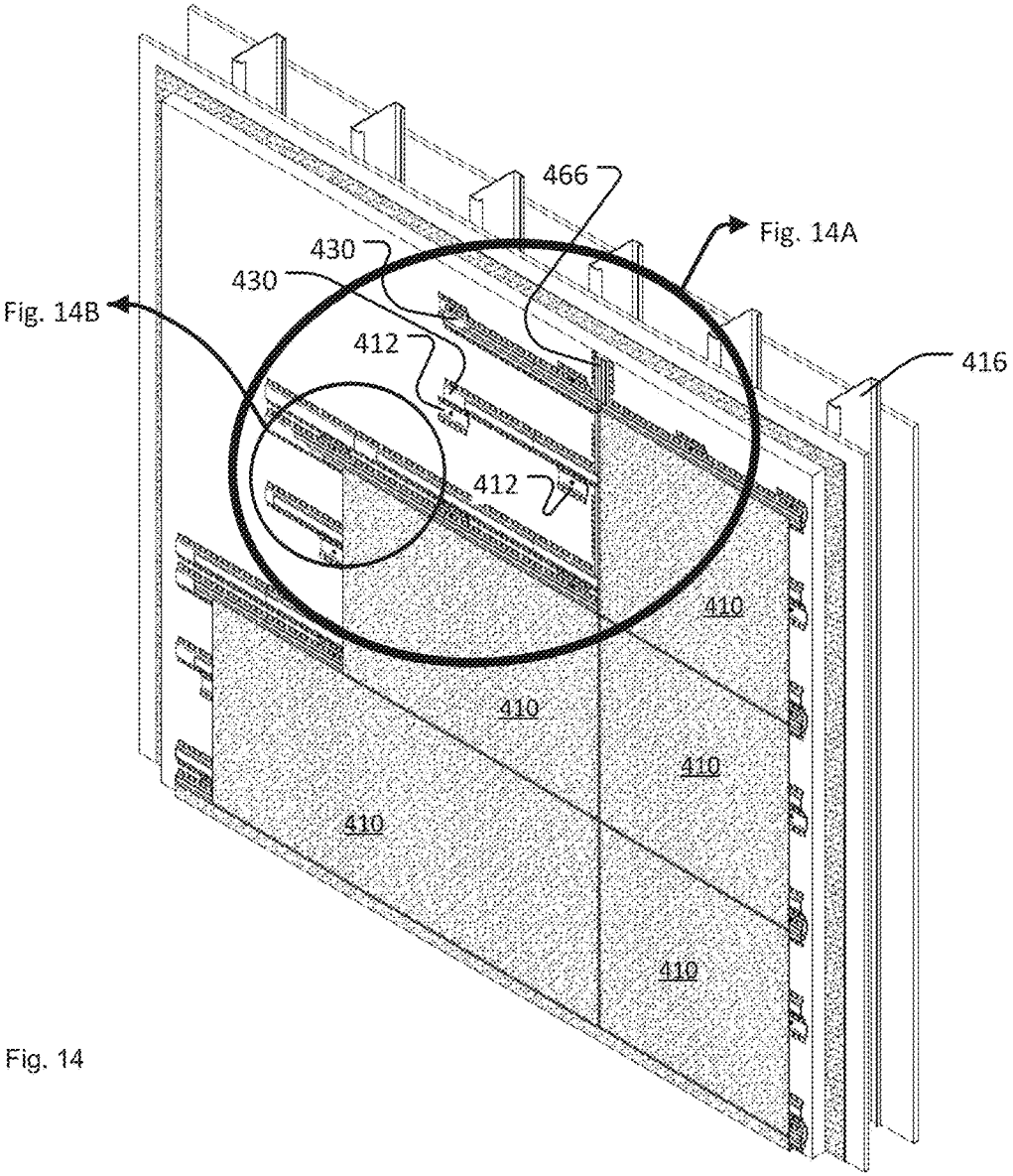
FIG. 14 is a schematic perspective view illustrating a wall clad using the embodiment of a wall sheathing system illustrated in FIG. 13, with FIGS. 14A and 14B being enlarged views of the circled portions in FIG. 14.
Figure 14A:
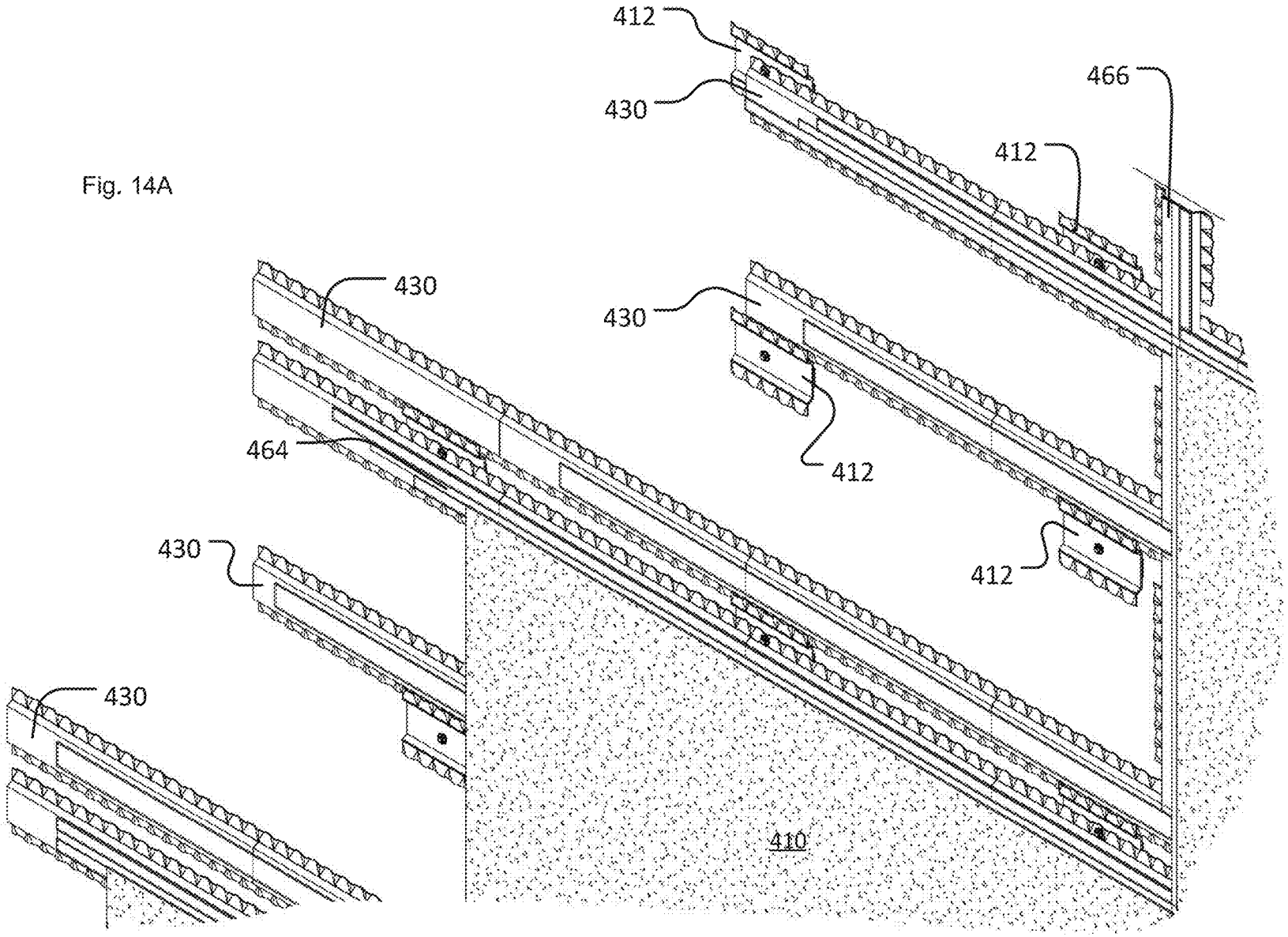
Figure 14B:
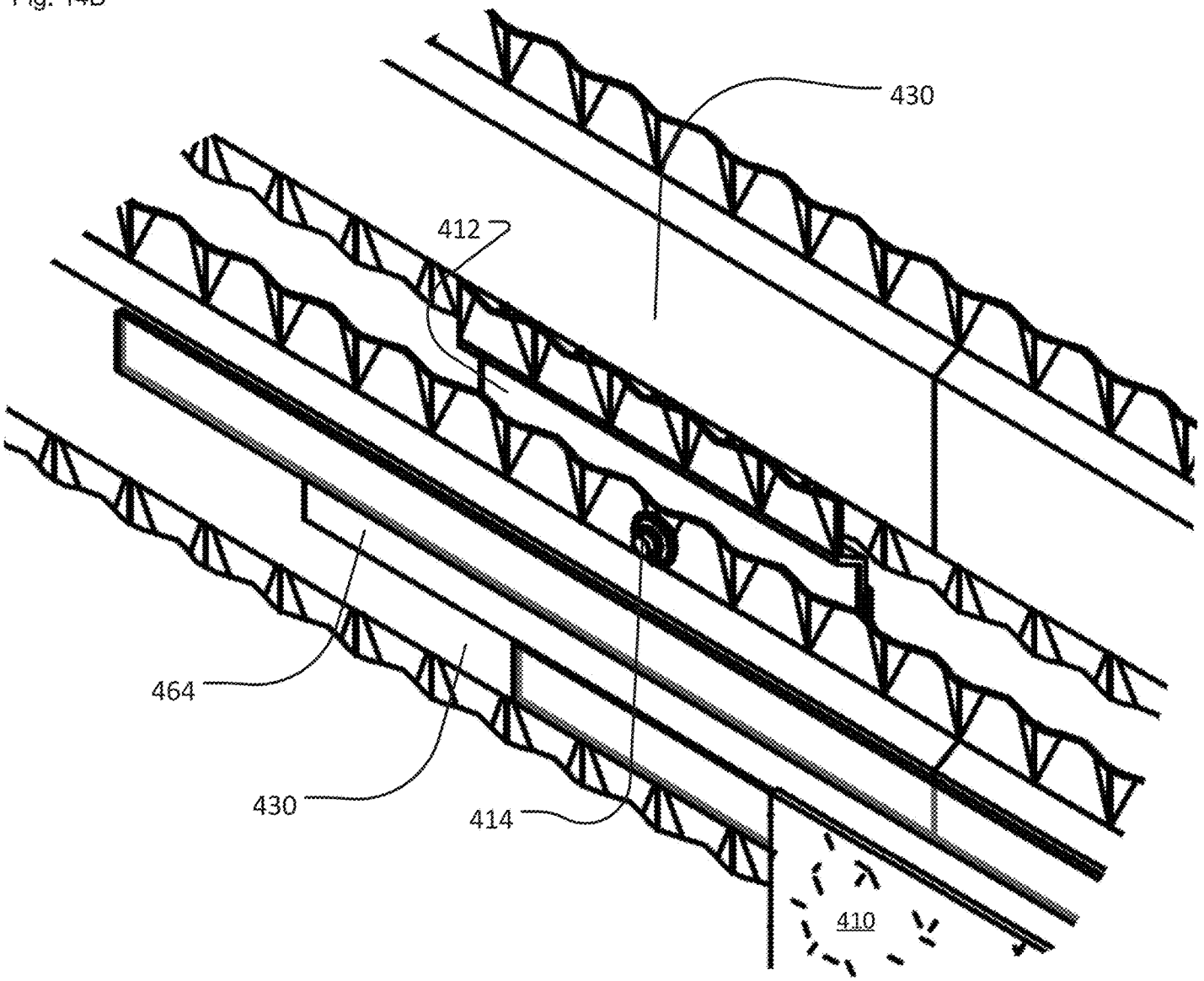
Figure 15:
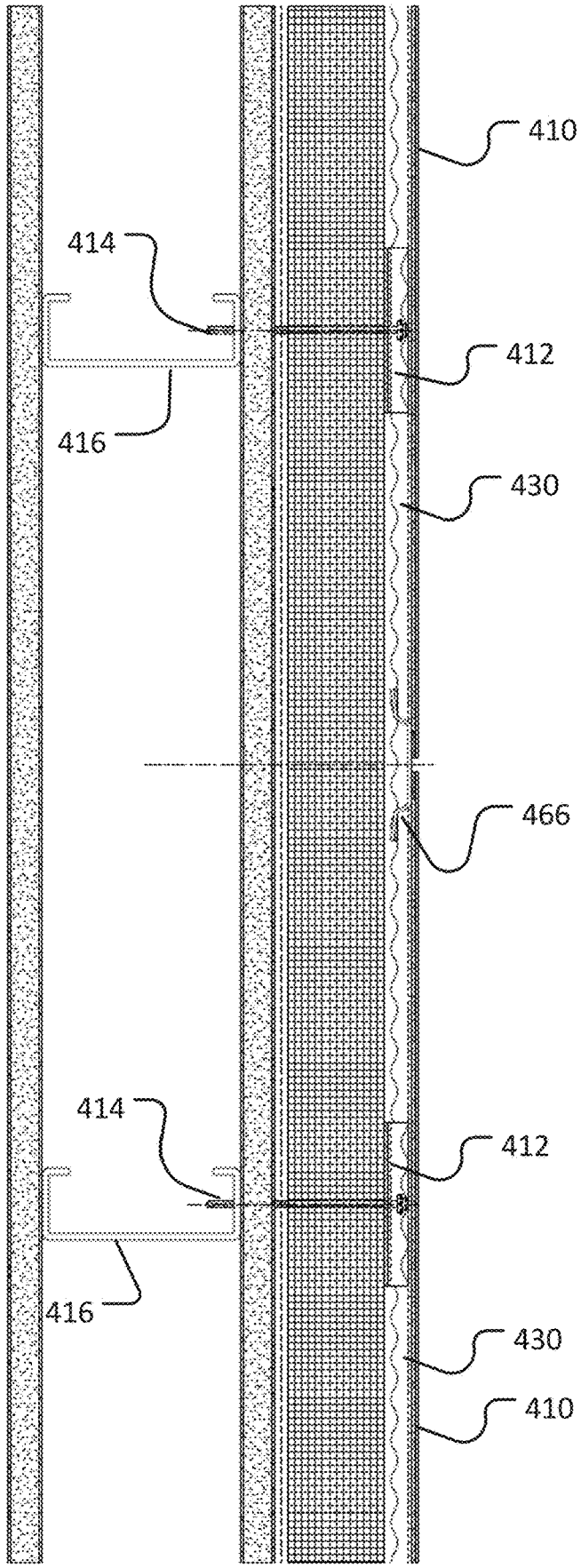
FIG. 15 is a schematic plan section view illustrating a wall clad using the embodiment of a wall sheathing system illustrated in FIG. 13.

If desired, the portions 464 of the webs of the corrugated furring channels that "peek out" between adjacent panels can be painted for aesthetics. Furthermore, as illustrated in FIGS. 14 and 14A, additional corrugated furring channels 466 can be attached (e.g., via their flanges) to the wall structure 420 in a vertical orientation, with their flanges adjacent to the surface of the wall structure 420 and their webs spaced away from the surface of the wall structure. By having the horizontal corrugated furring channels 430 extend less than completely across the width of the panels 410 so that a portion of panel extends past the ends of the corrugated furring channels 430, the panels 410 can be mounted to the wall structure and slid horizontally within the mounting brackets 412 until the ends of the horizontal corrugated furring channels 430 contact the flanges of the vertically oriented corrugated furring channels 466, with the free edges of the panels extending horizontally so as to overlap the webs of the vertically oriented furring channels 466. If the panels 410 and furring channels 430 are dimensioned so that portions of the webs of the vertically oriented furring channels 466 remain visible between adjacent panels, the exposed portions of the webs of the vertically oriented furring channels 466 can also be painted for aesthetics.

This approach to sheathing a building provides several benefits. First, as alluded to above, the lengths of very high bond-strength tape in the various locations form excellent seals to keep out moisture, all without requiring caulk (which can be messy and difficult to apply neatly). Additionally, as also alluded to above, the mounting arrangement keeps the panels spaced away from the wall structure, thereby providing a thermal break between the wall structure and the panels (which can absorb a lot of heat on hot and/or sunny days and which could otherwise draw and dissipate a lot of heat from the interior of the building on cold days). This renders the building more thermally efficient. Furthermore, the very high bond-strength tape on the rear surface of the mounting bracket web, through with the fasteners (e.g., gasketed self-tapping screws) pass, provides a second "level" of sealing around the fasteners due to the thickened, slightly compressible nature of the tape. This helps to reduce the amount of moisture that can "work its way" into the wall structure. Further still, the system eliminates all unsealed fasteners, and it creates a stacking system that greatly enhances alignment of the panels up the wall.

Furthermore, the mounting arrangement provides a "floating" system in which the panels are held away from—but connected to—the wall structure, without any fasteners passing through the panels. In addition to eliminating seepage of moisture through the panels into the space behind the panels, the "floating" nature of the panels facilitates settling and other shifting/movement of the building without the cladding buckling, wrinkling, warping, etc. As illustrated in FIG. 18, for example, the building may have a movement joint 468, i.e., a gap between building wall components 472 lying beneath the continuous insulation 474 and a deflection track system 470 to permit vertical movement of the walls relative to each other while preventing the walls from moving out-of-plane with respect to each other. Backer plate 476 extends the "reach" of the web of the upper corrugated furring channel 430 and allows the lower edge of the panel 410 above a given panel 410 to slide over the surface of the backer plate. This arrangement reduces or prevents moisture penetration while allowing for relative vertical movement of the panels 410. Additionally, an intermediate corrugated hat channel 478 is mounted to the surface of the wall structure 410 slightly farther away from the upper edge of the upper corrugated furring channel 430 of the panel located below a given panel 410 than illustrated, e.g, in FIGS. 4 and 4A, and two or three layers of very high bond-strength tape 480 are added to the web of the intermediate corrugated hat channel 478 as a shim or standoff to support the overlying panel 410. Because the layers of very high bond-strength tape 480 are slightly spongy or spring, the "stack" can "rock" slightly, thereby permitting the two panels illustrated in FIG. 18 to move vertically relative to each other.

The design and construction principles described above can be implemented in connection with numerous other panel configurations. For example, while the panels 410 described above have length-to-width aspect ratios on the order of 1 or 1.5 to on the order of 3 or 4, the same principles can be used in connection with much longer, plank-shaped panels having length-to-width aspect ratios on the order of 8 or 10 or so, as illustrated in FIGS. 19-21. For such plank-shaped panels 510, the primary difference as compared to the configuration described above is that only two corrugated furring channels 530 need be provided extending along the length of each plank-shaped panel 530, as shown in FIGS. 20 and 21. Additionally, while an installation using plank-shaped panels 530 might desirably have "reveals" (i.e., gaps) between vertically adjacent panels 530 as in the configuration described above, which "reveals" leave surfaces of the underlying, supporting furring channels 530 exposed (possibly to be painted), it may be desirable for horizontally adjacent panels 530 to butt up against each other without there being any "reveals"—to present a more continuous, uniform appearance. In that case, vertically oriented furring channels (such as additional corrugated furring channels 466 shown in FIGS. 14 and 14A) can be foregone.

Alternatively, the construction techniques described above can be adapted for use with plank-shaped panels arranged in overlapping fashion, e.g., as in common residential siding. The primary difference between this arrangement and those described above is that mounting brackets are not used, nor are vertically oriented furring channels such as additional corrugated furring channels 466 shown in FIGS. 14 and 14A. This overlapping-plank configuration is illustrated in FIGS. 22-27, where elements that are the same as/similar to elements illustrated in FIGS. 13-18 and described above are identified by reference numerals having the same last two digits as those used in FIGS. 13-18 but starting with the numeral 6. Given the similarity, specific discussion/explanation is not provided, except to explain the installation process with reference to FIGS. 25 and 25A.

Figure 25:
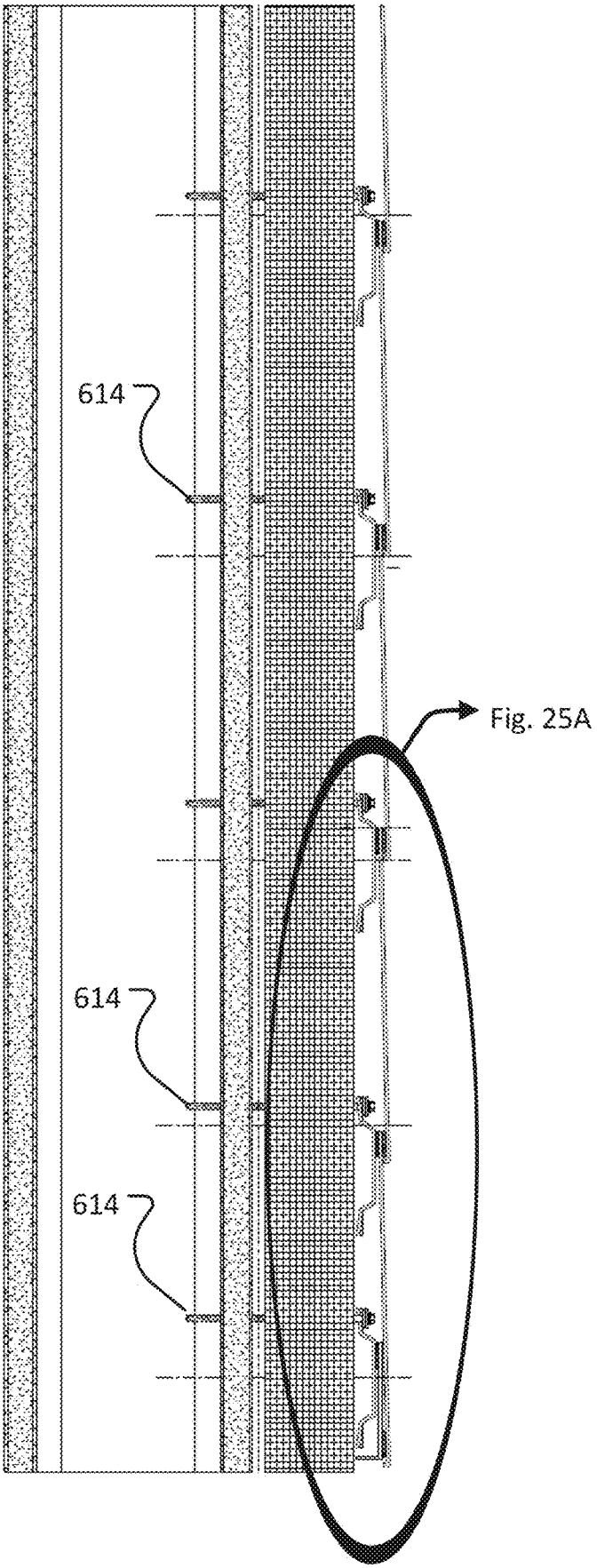
FIG. 25 is a schematic side section view illustrating the wall clad using the embodiment of a wall sheathing system illustrated in FIG. 22, with FIG. 25A being an enlarged view of the circled portion in FIG. 25.
Figure 25A:
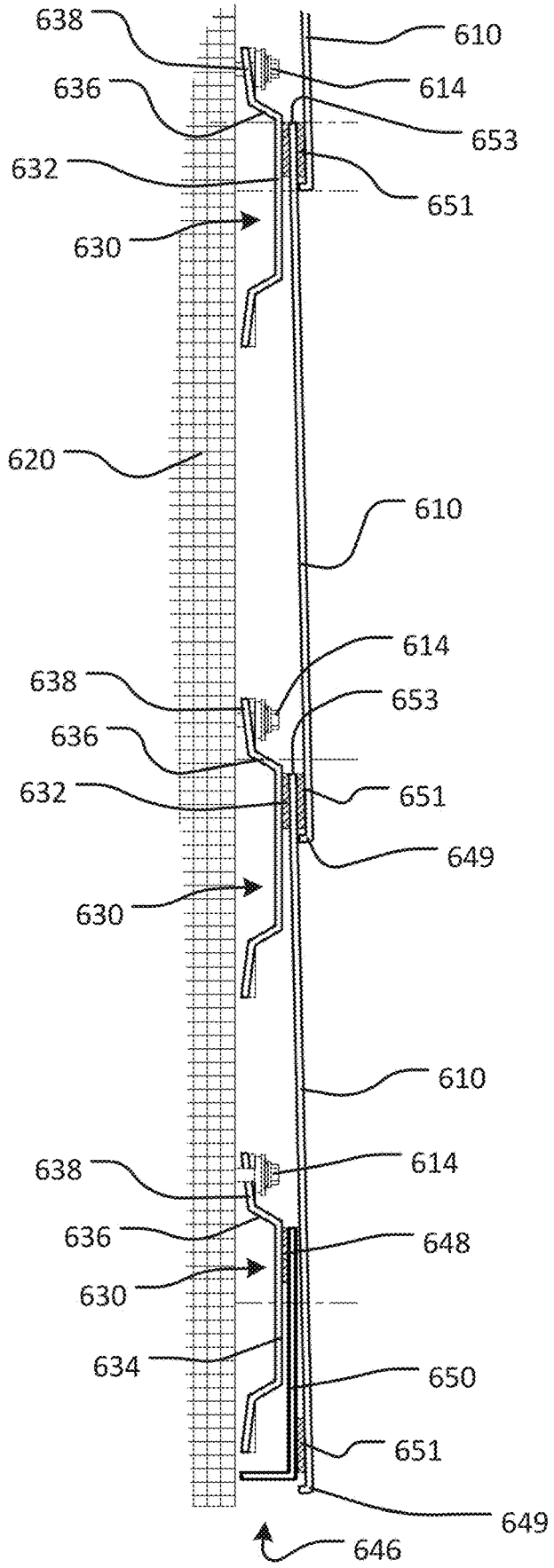
Figure 26:
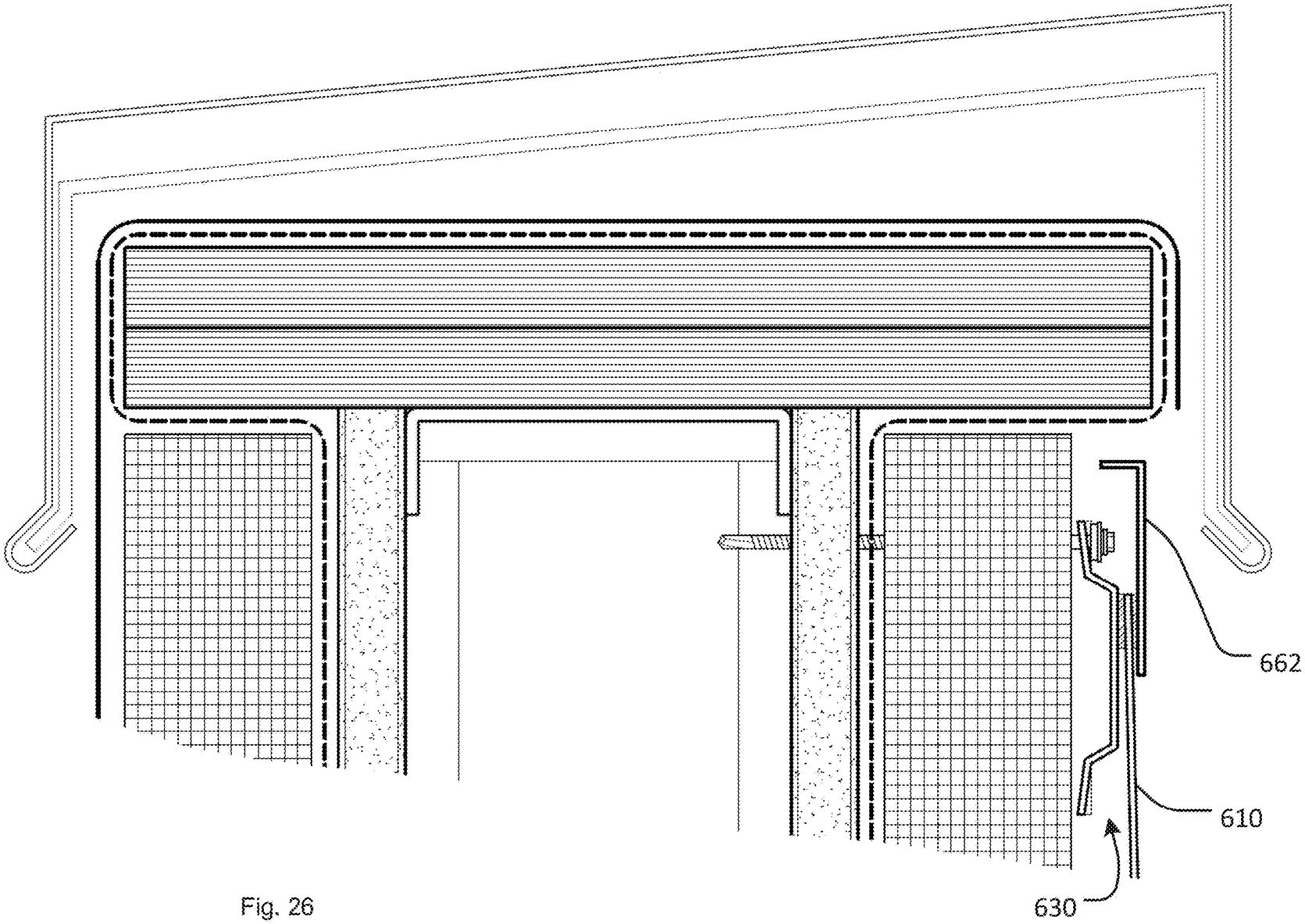
FIG. 26 is a schematic side section view illustrating upper portions of the wall illustrated in FIG. 25.
Figure 27:
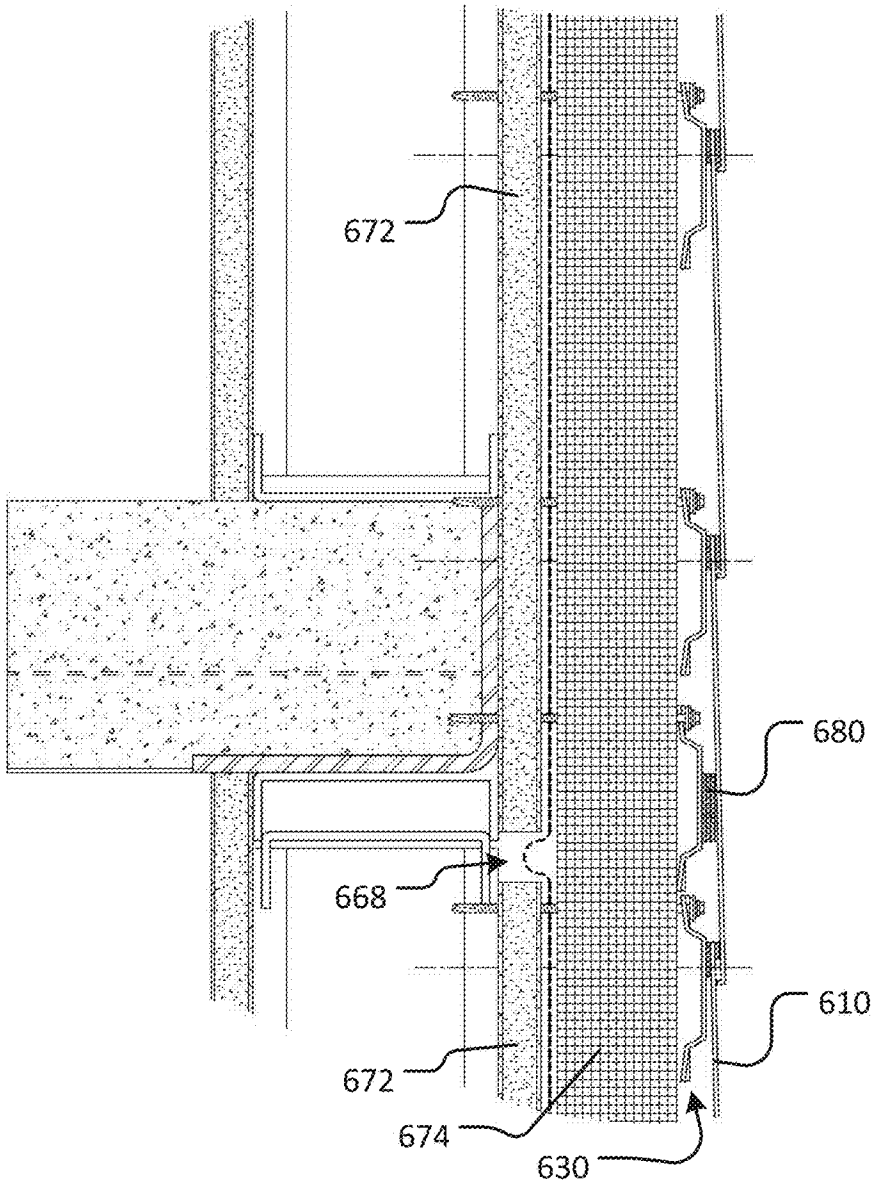
FIG. 27 is a schematic side section view illustrating an expansion joint in a wall as illustrated in FIG. 25.

As illustrated in FIGS. 25 and 25A, the lower edge 649 of each panel 630 may be bent inward slightly, and a length of very high bond-strength tape 651 may be pre-applied to the rear surface of the panel 630 just above the lower edge 649. A single corrugated furring channel 630 is attached to the rear surface of the panel 630 near the upper edge of the panel 653 via a length of very high bond-strength tape 632, with a portion (e.g., the upper leg 636 and upper corrugated flange 638) extending upwardly past the upper edge of the panel 653. As further illustrated in FIGS. 25 and 25A, a starter unit 646 consists of an L-shaped trim piece 650, which is secured to the web 634 of a corrugated furring channel 630 by a length of very high bond-strength tape 648.

Figure 23:
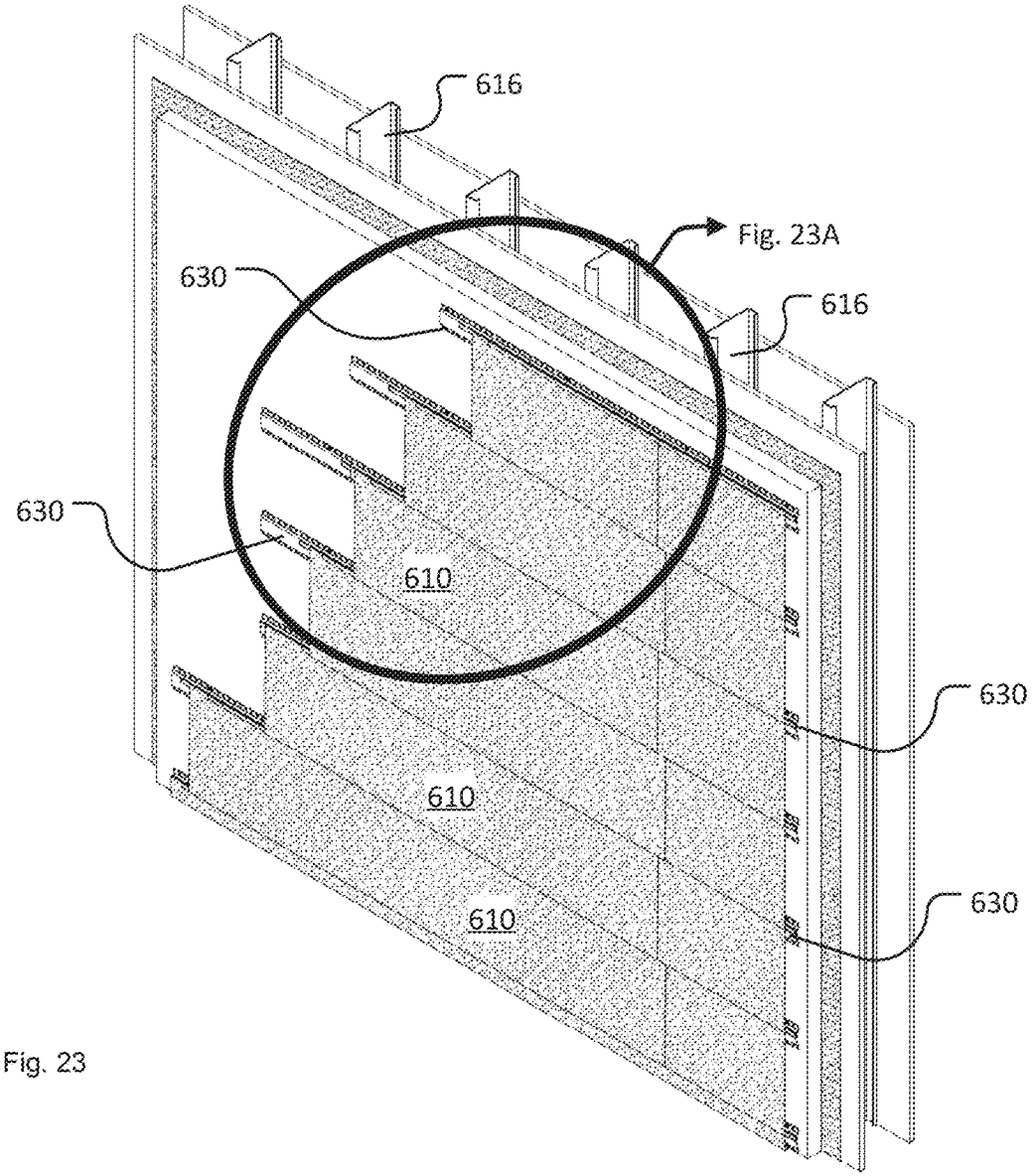
FIG. 23 is a schematic perspective view illustrating a wall clad using the embodiment of a wall sheathing system illustrated in FIG. 22, with FIG. 23A being an enlarged view of the circled portion in FIG. 23.
Figure 23A:
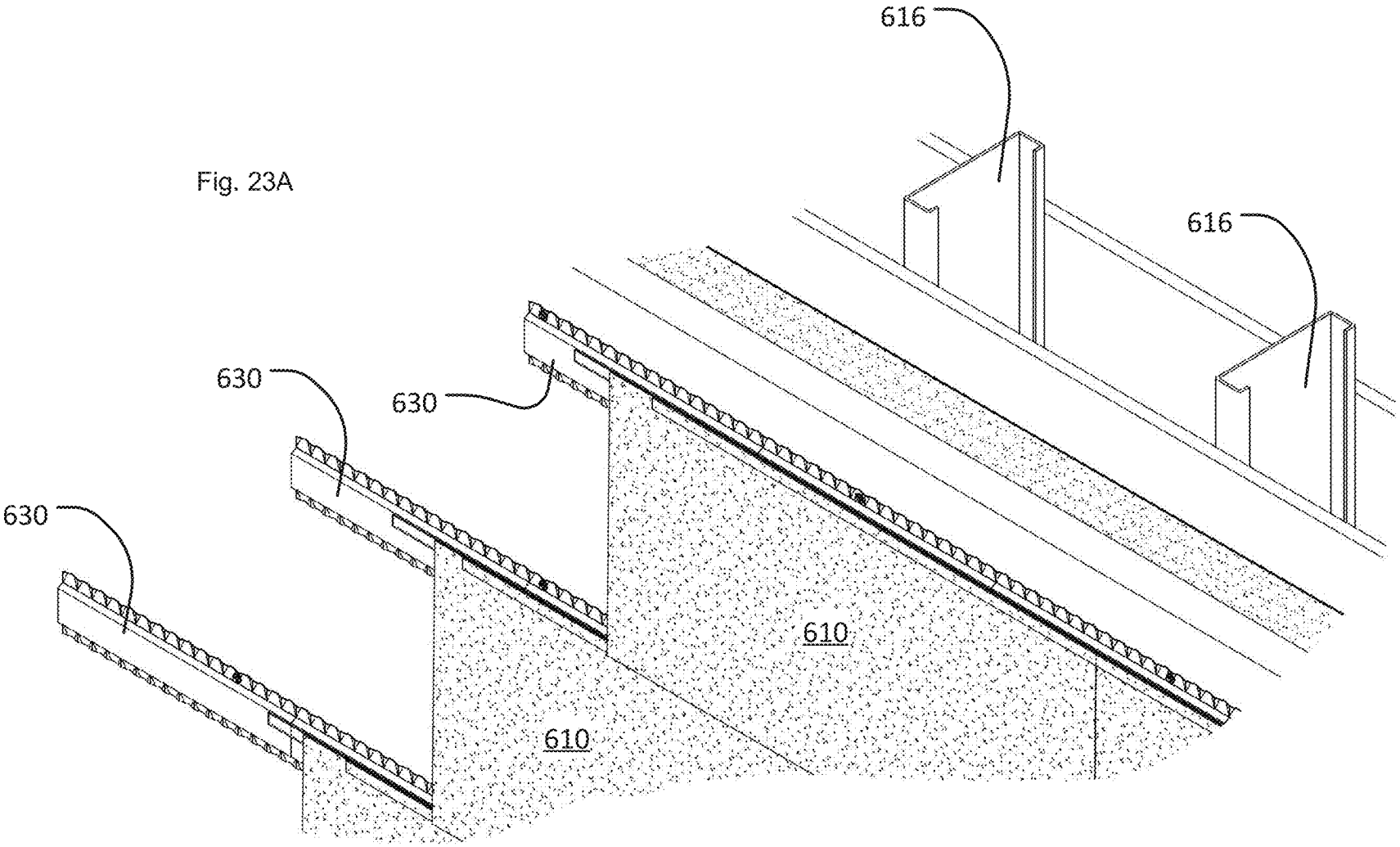
Figure 24:
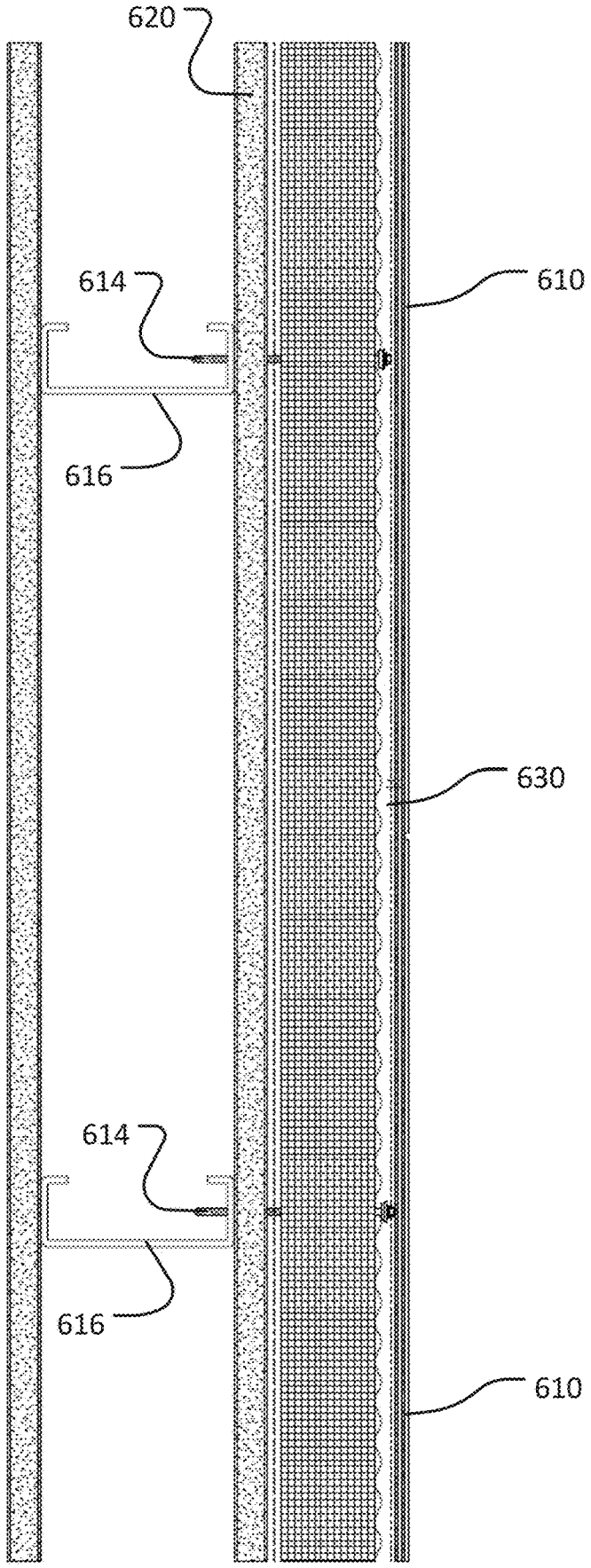
FIG. 24 is a schematic plan section view illustrating a wall clad using the embodiment of a wall sheathing system illustrated in FIG. 22.

Installation of the panels 630 proceeds "from the bottom up." It begins by placing the starter unit 646 against the surface of wall structure 620 near the bottom and attaching it to the wall structure 620 by driving self-tapping screws 614 through the upper corrugated flange 638 of the starter-unit corrugated furring channel 630 and into studs 616 (FIG. 23). The release liner is removed from the length of very high bond-strength tape 651 near the bottom of a panel 610 and the panel 610 is positioned against the wall structure, with the very high bond-strength tape 651 adhering to the surface of the L-shaped trim piece 650 and the corrugated furring channel 630 that is attached to the opposite, upper end of the panel 610 bearing against the surface of the wall structure. The panel 610 is then secured to the wall by driving self-tapping screws 614 through the upper corrugated flange 638 of the corrugated furring channel 630 that is attached to the panel 610 and into studs 616. Subsequent panels are applied in the same manner working one's way up the wall, but with the length of very high bond-strength tape 651 near the lower edge 649 of each successive panel being adhered to the outer surface of the previously installed panel 610, just overlapping the upper edge portion thereof of the previously installed panel 610.

Various modifications to and departures from these disclosed embodiments will occur to those having skill in the art. What is to be protected by this patent is set forth in the following claims.

What is claimed is:

1. A structural assembly, comprising:

a vertical wall structure;

a rail bracket attached to the vertical wall structure and extending in a horizontal direction with an upwardly extending, corrugated, rail-bracket free flange; and a panel having a horizontally extending furring channel attached to a back surface thereof, the furring channel having a central base portion by means of which the furring channel is attached to the back surface of the panel and a first corrugated furring-channel flange that extends in a downward direction;

wherein the panel is mounted to the wall structure, with at least some freedom to move relative to the wall structure, by means of the first corrugated furring-channel flange hooking onto the corrugated rail-bracket free flange, and wherein the corrugated nature of the rail-bracket free flange and the first furring-channel flange provides spaces through which moisture drains from between the panel and the wall structure and through which air circulates.

2. The structural assembly of claim 1, wherein the furring channel is attached to the back surface of the panel by a foam-core, double-sided tape disposed between the central base portion of the furring channel and the back surface of the panel.

3. The structural assembly of claim 1, wherein the furring channel has a hat-shaped cross-sectional profile, with a second corrugated furring-channel flange that extends in an upward direction.

* * * * *